US007808402B1

(12) United States Patent
Colby

(10) Patent No.: US 7,808,402 B1
(45) Date of Patent: Oct. 5, 2010

(54) MULTI-MODE TRAFFIC SIGNAL BULB ASSEMBLY

(76) Inventor: Steven M. Colby, P.O. Box 52033, Palo Alto, CA (US) 94303

( * ) Notice: Subject to any disclaimer, the term of this patent is extended or adjusted under 35 U.S.C. 154(b) by 903 days.

(21) Appl. No.: 11/258,482

(22) Filed: Oct. 25, 2005

Related U.S. Application Data

(60) Provisional application No. 60/622,192, filed on Oct. 25, 2004.

(51) Int. Cl.
*G08G 1/095* (2006.01)

(52) U.S. Cl. ..... 340/907; 200/19.17

(58) Field of Classification Search ..... 340/931, 340/907

See application file for complete search history.

(56) References Cited

U.S. PATENT DOCUMENTS 3,895,345 A * 7/1975 Elvers et al. ..... 340/907
4,358,710 A * 11/1982 Magai ..... 315/101
5,594,433 A * 1/1997 Terlep ..... 340/908.1
6,054,932 A * 4/2000 Gartner et al. ..... 340/815.65
6,072,407 A * 6/2000 Shin ..... 340/907
6,331,824 B1 * 12/2001 Firestone ..... 340/929
6,567,010 B1 * 5/2003 Lin et al. ..... 340/815.67
6,762,689 B2 * 7/2004 Dechape ..... 340/815.45
2002/0027510 A1 * 3/2002 Jones et al. ..... 340/907
2003/0095052 A1 * 5/2003 Dechape ..... 340/908
2004/0051474 A1 * 3/2004 Wong ..... 315/291

* cited by examiner

*Primary Examiner*—Toan N Pham
*Assistant Examiner*—Kerri McNally

(57) ABSTRACT

Systems and methods of controlling traffic including a traffic signal. The traffic signal including one or more lamps configured to each display a plurality of patterns by selectively powering different groups of bulbs. Embodiments of the invention include lamps configured to alternatively display an arrow pattern, a filled circle pattern, a bar pattern or other pattern meaningful to traffic control. The pattern displayed is optionally dependant on available power sources, ambient light, traffic flow, time of day or day of week. Embodiments of the invention include a bulb assembly including different groups of bulbs and configured to be controlled using as few as two hot electrical inputs.

23 Claims, 28 Drawing Sheets

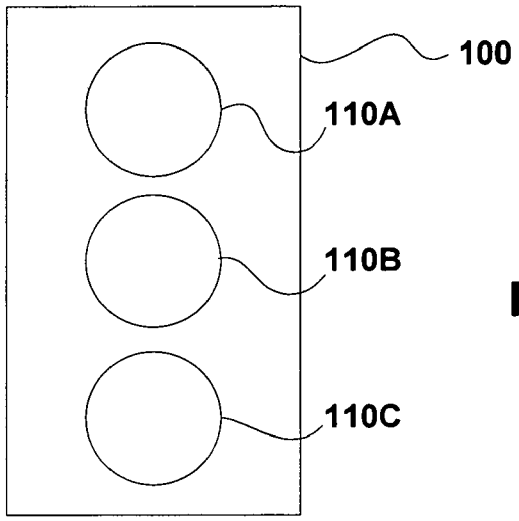
FIG. 1
Prior Art
FIG. 3
Prior Art
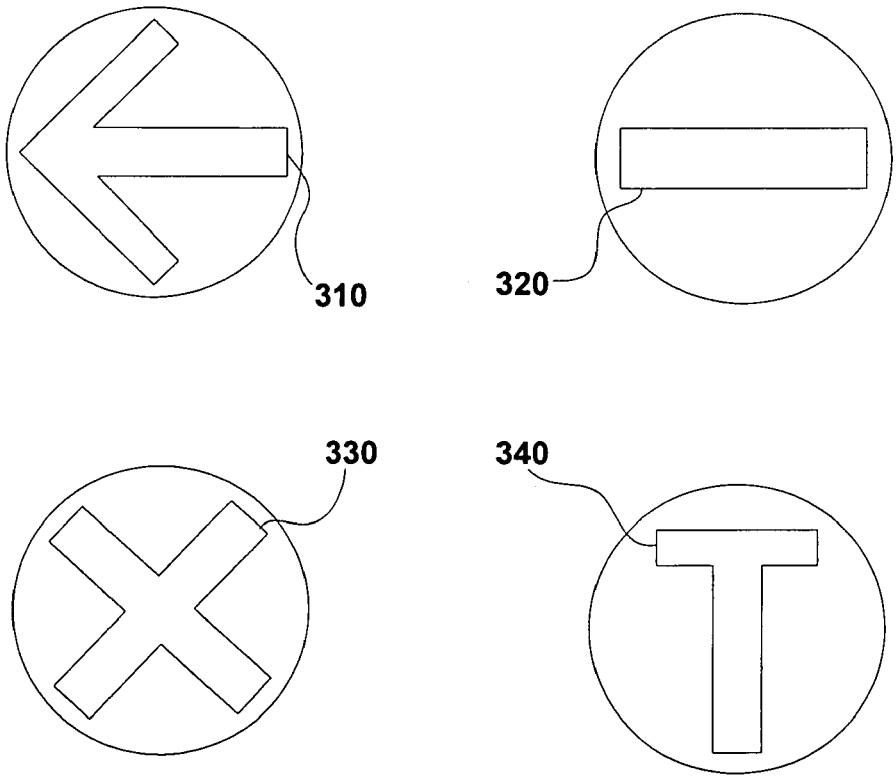

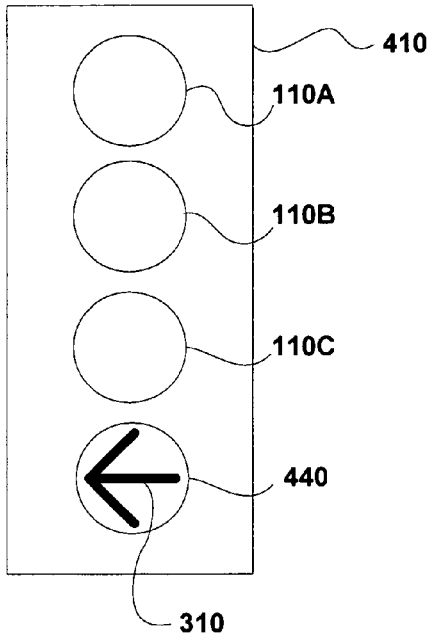
FIG. 4A
Prior Art
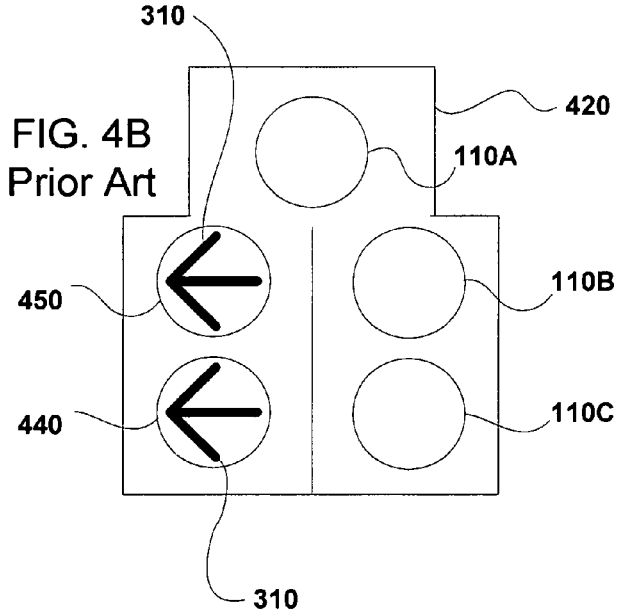
FIG. 4B
Prior Art
FIG. 4C
Prior Art
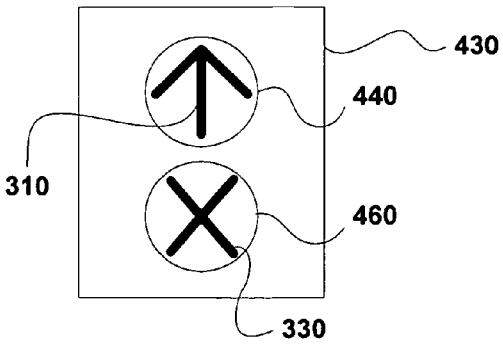

MULTI-MODE TRAFFIC SIGNAL BULB ASSEMBLY

CROSS-REFERENCE TO RELATED APPLICATIONS

This application claims benefit of commonly owned U.S. Provisional Patent Application 60/622,192 filed Oct. 25, 2004 and entitled "Multi-Mode Traffic Signal Bulb Assembly," the disclosure of which is hereby incorporated herein by reference.

BACKGROUND

1. Field of the Invention

The invention is in the field of signaling and specifically in the field of traffic control using signal lights.

2. Related Art

FIG. 1 illustrates a prior art traffic signal 100 typically including three or more lamps 110A-110C. In a standard format these lamps are co-linear, shine with distinguishable colors red, yellow, and green, and display a filled circle pattern. When mounted vertically the red lamp is by convention (in the United States) located above the yellow and green lamps. As shown in FIG. 2A, each lamp 110 includes a single bulb 210 or alternatively, as shown in FIG. 2B, a series of bulbs 220 such as LEDs (light emitting diodes). Lamp 110 may also includes an optional lens (not shown) that modifies the apparent color of a bulb 210 or series of bulbs 220. For example a red lamp 110 may have a red lens that makes light from the lamp appear red in color.

Lamp 110 optionally has a pattern (mask or shape) that forms a pattern meaningful to traffic control, such as an arrow or a default filled circle pattern, in a lit surface. FIG. 3 illustrates four of these patterns, in addition to the default filled circle pattern, having different meaning to traffic control. An arrow pattern 310 is used for directional control. A bar pattern 320 and a "T" pattern 340 are used to control rail traffic. A cross pattern 330 is used in a variety of applications such as traffic direction control. Each pattern is rotated to other orientations and is used with a variety of colors. Both pattern and color determine the function of an individual lamp 110 meaningful to traffic control.

FIGS. 4A through 4C illustrate variations of prior art traffic signal 100. Advanced traffic signal 410 includes a green lamp 440 with an arrow pattern 310 used for direction control. In the figures, lamp 110, not showing a specific pattern, are meant to illustrate a default filled circle pattern. Advanced traffic signal 420 includes a yellow lamp 450 with arrow pattern 310 used for direction control. Advanced traffic signal 430 includes a red lamp 460 with a cross pattern 330 and a green lamp 440 with an arrow pattern 310 rotated ninety degrees. Advanced traffic signal 430 is used for lane control. Advanced variations of traffic signal 110, such as those illustrated, can include three or more lamps. A large number of lamp 110 in traffic signal 100 is a disadvantage. Each lamp 110 contributes to the cost and weight of traffic signal 100. Prior art lamp 110 does not have variable patterns that allow an individual lamp to provide variable information meaningful to traffic control displays. For example as a signal cycles through a display pattern, wherein alternative lamps are lit, a light pattern on an individual lamp cannot be changed from a default filled circle pattern to an arrow pattern 310 of the same color. Lamps 440, 450, and 460 are variations of lamp 110.

Prior art traffic signals are supported by supporting elements such as poles and cables. The weight of the traffic signal is a factor in the requirements and, therefore, cost of the support elements. In a typical installation several traffic signals are supported by one or more supporting elements and coupled through a single control module including electronics.

BRIEF DESCRIPTION OF THE VARIOUS VIEWS OF THE DRAWING

FIG. 1 illustrates a prior art traffic signal;

FIG. 3 illustrates four prior art patterns used for traffic control;

FIGS. 4A through 4C illustrate variations of a prior art traffic signal;

SUMMARY OF THE INVENTION

Figure 2A:
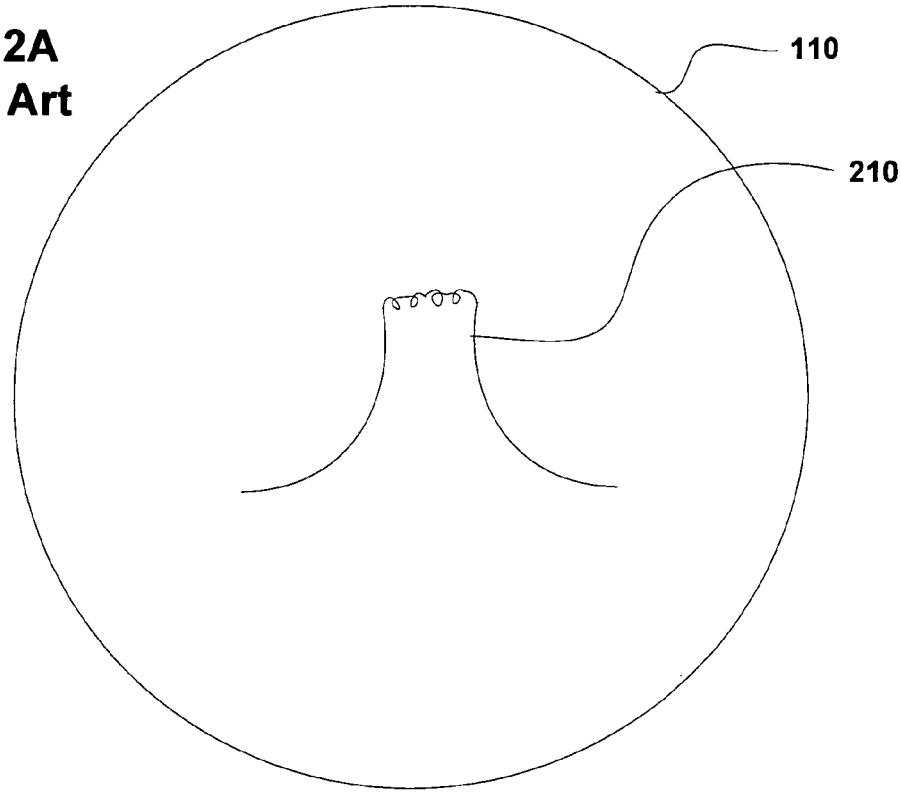
FIG. 2A Prior Art
FIG. 2A illustrates a prior art lamp including a single bulb.
Figure 2B:
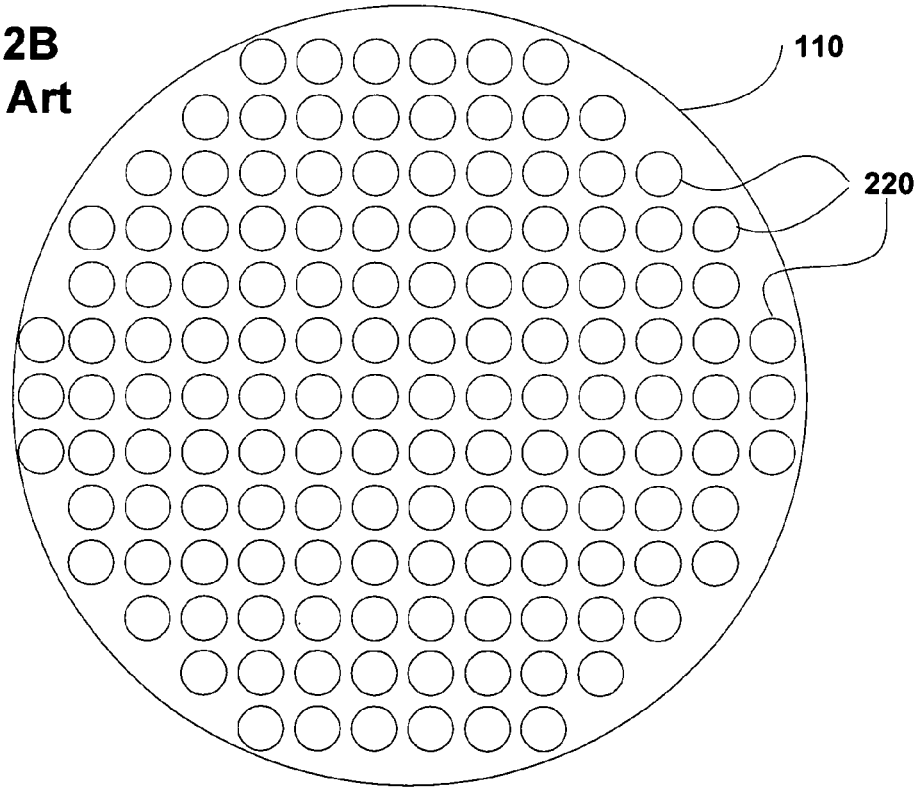
FIG. 2B Prior Art
FIG. 2B illustrates a prior art lamp including a series of bulbs, such as LEDs.

A traffic signal includes a lamp configured to present a plurality of light patterns optionally using shared bulbs. A single lamp with a variable light pattern enables the number of lamps in a traffic signal to be reduced without decreasing the utility of the traffic signal. Variable light patterns are achieved by separately controlling different bulbs within a single lamp. A single bulb is optionally used as a component of more than one alternative pattern. In some embodiments, commonly used patterns, such as an arrow and a filled circle, are alternatively displayed in a single lamp.

Some embodiments of the invention include a traffic signal comprising a support structure, a housing supported by the support structure, an electronic circuit, a first lamp at least partially contained within the housing, a second lamp at least partially contained within the housing and configured to display, responsive to the electronic circuit, a plurality of patterns having a plurality of meanings to traffic control.

Some embodiments of the invention include a traffic signal comprising a first housing, a first group of bulbs disposed within the first housing, a second group of bulbs disposed within the first housing and having at least one bulb in common with the first group of bulbs, a first lamp at least partially contained within the first housing and including the first group of bulbs and the second group of bulbs, each of the first group of bulbs and the second group of bulbs being disposed to display a different pattern meaningful to traffic control, and an electronic circuit configured to control a state of bulbs in the first group separately from bulbs in the second group.

Some embodiments of the invention include a traffic signal comprising a support structure, a housing supported by the support structure, a first lamp at least partially contained within the housing, a second lamp at least partially contained within the housing, an electronic circuit including a plurality of switches, with on/off positions configured to control the second lamp, a first on/off state of the plurality of switches configured such that the second lamp displays a first pattern meaningful to traffic control, and a second on/off state of the plurality of switches configured such that the second lamp displays a second pattern meaningful to traffic control.

Some embodiments of the invention include a traffic signal comprising a first housing, an electronic circuit, a first lamp at least partially contained within the first housing, a second lamp at least partially contained within the first housing and configured to display a plurality of patterns having different meanings to traffic control, the second lamp being responsive to the electronic circuit, a color of the displayed pattern being deducible using the position of the second lamp relative to the first lamp.

Some embodiments of the invention include a traffic signal comprising a housing, a group of bulbs disposed to display a pattern meaningful to traffic control, a lamp at least partially contained within the housing and including the group of bulbs, an array of lenses, including more than one lens, disposed to direct light generated by the group of bulbs, and an electronic circuit configured to control the group of bulbs.

Some embodiments of the invention include a method of controlling traffic including the steps of supporting a traffic signal having a plurality of lamps, placing the traffic signal in a first state in which a first lamp, of the plurality of lamps, displays a first pattern meaningful to traffic control, and, placing the traffic signal in a second state in which the first lamp displays a second pattern meaningful to traffic control, the second pattern being either a filled circle pattern, an arrow pattern, a bar pattern, a "T" pattern, a polygon pattern, or a cross pattern.

Some embodiments of the invention include a method of controlling traffic including the steps of placing a traffic signal in a first state in which a first lamp, at least partially contained within a housing, displays a filled green circle and a second lamp, at least partially contained within the housing, displays no lit pattern, placing the traffic signal in a second state in which the first lamp displays a green arrow, and the second lamp displays a filled red circle, and placing the traffic signal in the first state again.

Some embodiments of the invention include a method of controlling traffic including the steps of placing a traffic signal in a first state in which a first lamp, at least partially contained within a housing, displays a filled green circle, and a second lamp, at least partially contained within the housing, displays a red arrow, and placing the traffic signal in a second state in which the first lamp displays a green filled circle and the second lamp displays no lit pattern.

Some embodiments of the invention include a method of attracting attention to a traffic signal comprising the steps of supporting a traffic signal having a plurality of lamps, a first lamp of the plurality of lamps including two or more separately controllable bulb groups, each bulb group configured to display essentially the same color and including more than one bulb, placing the traffic signal in a first state in which the first lamp displays a pattern meaningful to traffic control, and powering one of the separately controllable bulb groups on and off without changing the meaning of the pattern displayed by the first lamp.

DETAILED DESCRIPTION OF THE INVENTION

Figure 5A:
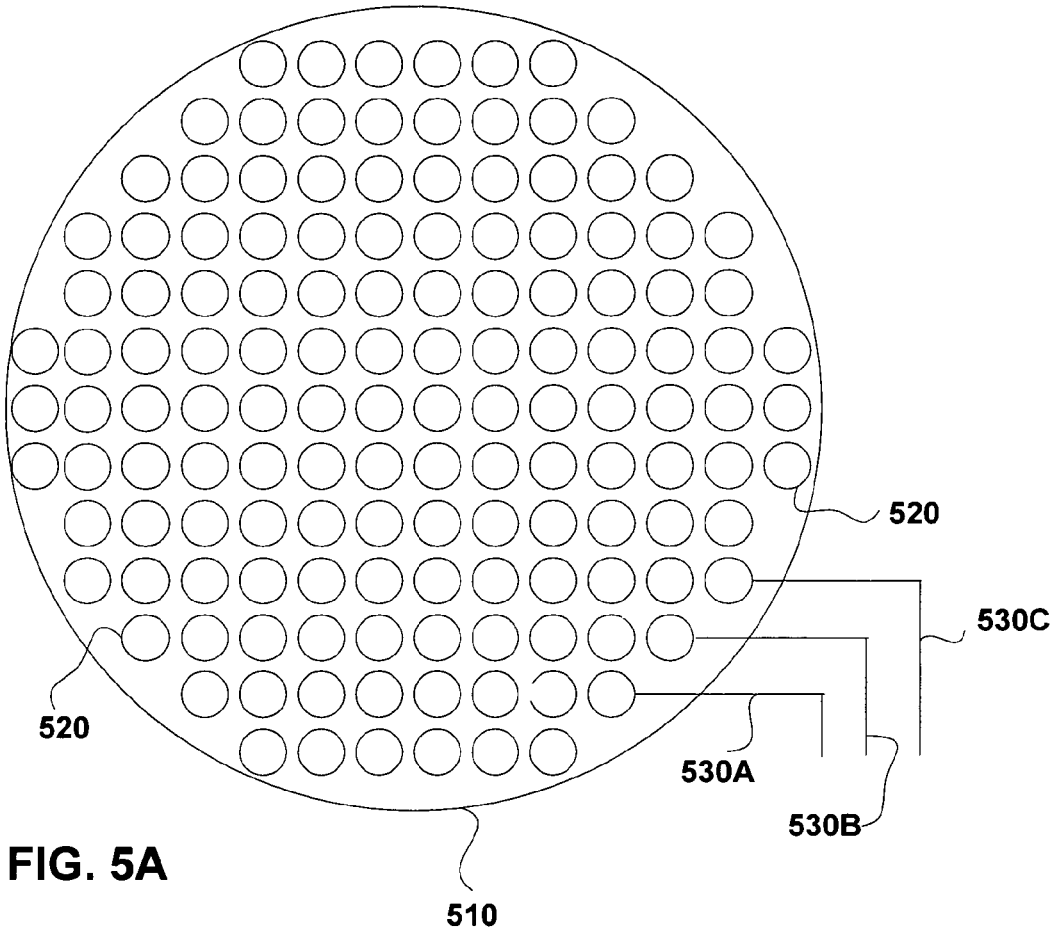
FIG. 5A illustrates an embodiment of a lamp including a plurality of bulbs, according to the invention.
Figure 5B:
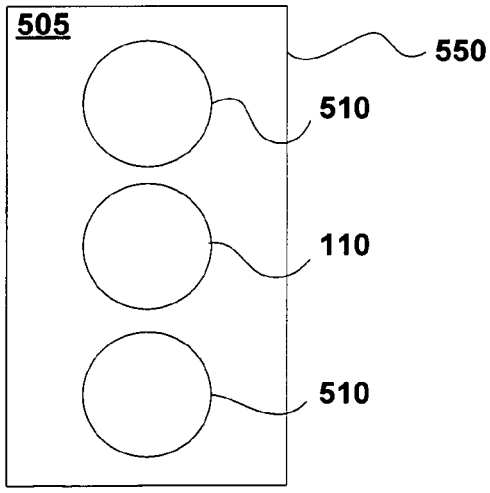
FIG. 5B illustrates an embodiment of a traffic signal including a housing and one or more lamp.

FIG. 5A illustrates an embodiment of a lamp 510, including a plurality of bulbs 520, according to the invention. Bulbs 520 are, for example, LEDs and are coupled to a plurality of electronic connections 530A-530C separately controllable. In some embodiments illumination of all bulbs in lamp 510 produces a filled circle pattern (such as seen in a red stop light). In some embodiments each lamp 510 displays light of specific color, such as green, red or yellow (amber). The color of lamp 510 is used in combination with standard patterns to convey specific meaning to specific traffic control. Variations in color, such as yellow and amber, that convey the same traffic control meaning are considered to be essentially the same color. FIG. 5B illustrates an embodiment of a Traffic Signal 550 including a housing 505 and one or more lamp 510 at least partially contained within housing 505.

Figure 6A:
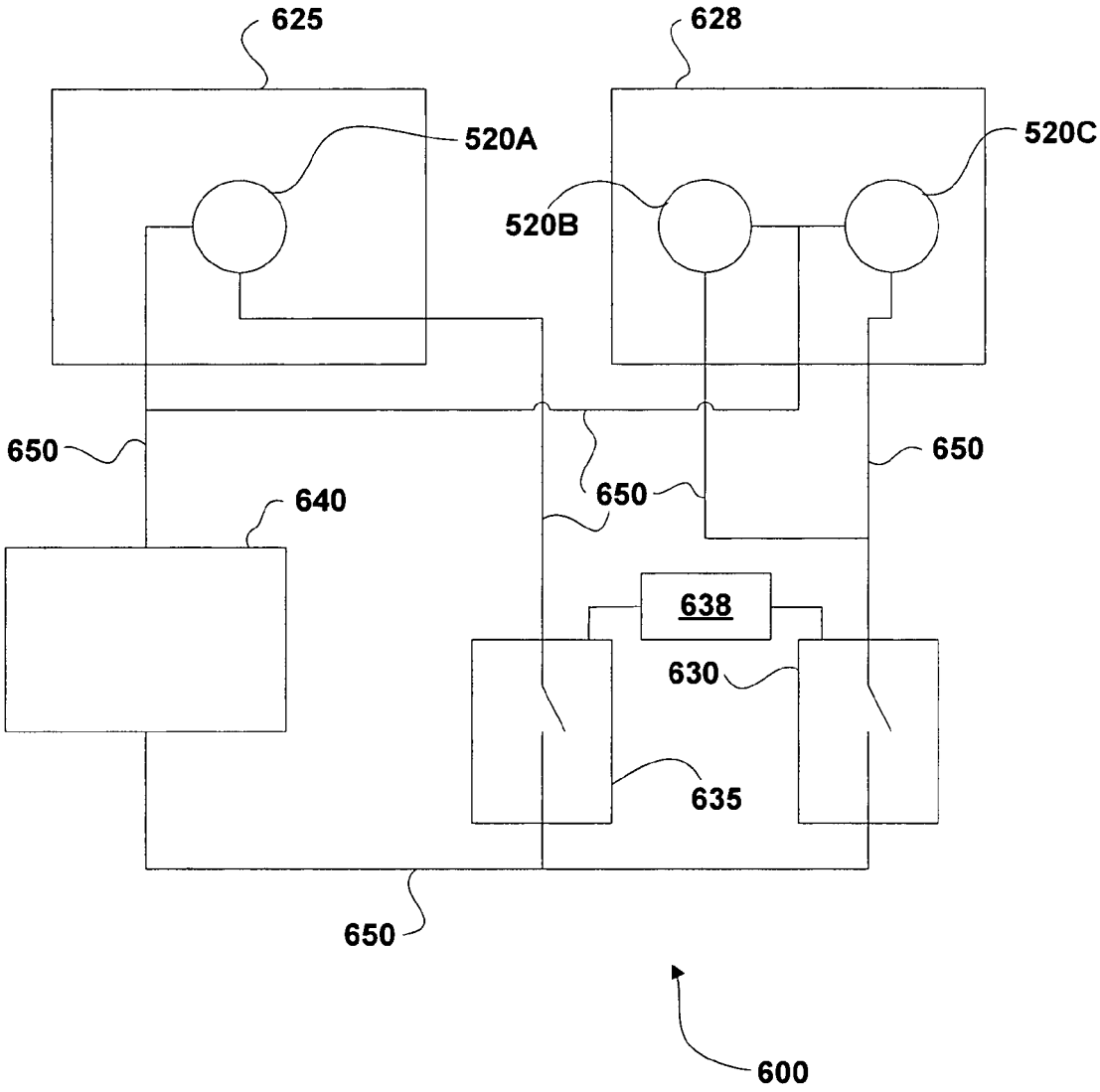
FIG. 6A illustrates an electronic circuit configured to separately control a plurality of bulbs.

FIG. 6A illustrates an electronic circuit, generally designated 600, including electrical connections 650 and configured to separately control a plurality of bulb 520, such as found in lamp 510. The plurality of bulb 520, included in lamp 510, are in two or more separately controllable bulb groups 625 and 628. Each of bulb group 625 and bulb group 628 are separately controlled through a switch 630 and a switch 635 respectively. Switch 630 and switch 635 have on/off states and are electronically controlled by a switch controller 638. The on/off states of switch 630 and switch 635 are configured to determine lit/unlit states of bulb 520 in bulb group 625 or bulb group 628. A power source 640 supplies power to electronic circuit 600 including bulb 520. Bulb group 625 and bulb group 628 optionally share individual bulb 520. Thus, an individual bulb 520 may be a member of a plurality of bulb groups such as bulb group 625 and bulb group 628.

Figure 6B:
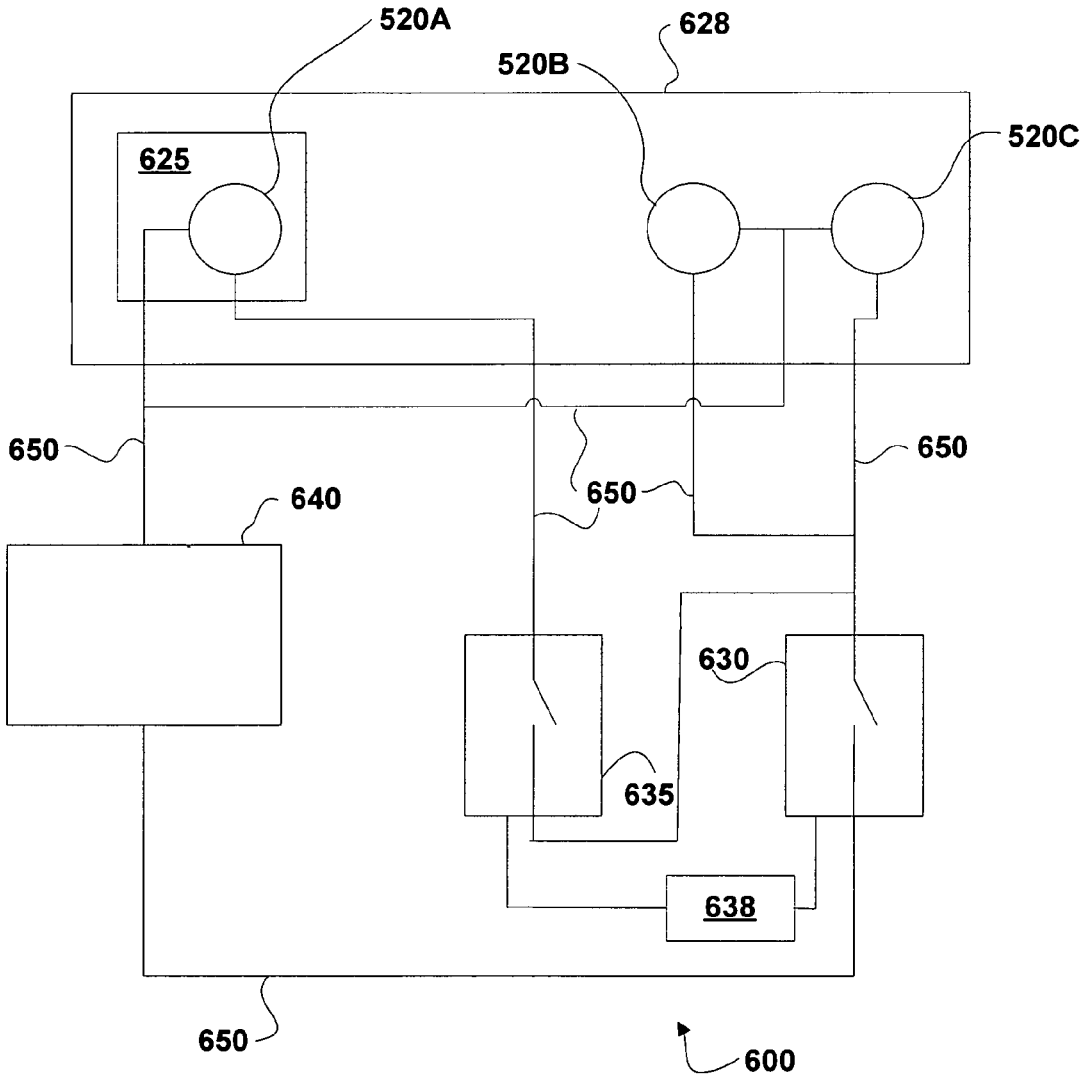
FIG. 6B illustrates an alternative embodiment of the electronic circuit in which two bulb groups are wired in series instead of in parallel.

FIG. 6B illustrates an alternative embodiment of electronic circuit 600 in which bulb group 625 and bulb group 628 are wired in series instead of in parallel. This embodiment is optionally used when bulb group 625 is a subset of bulb group 628.

Figure 6C:
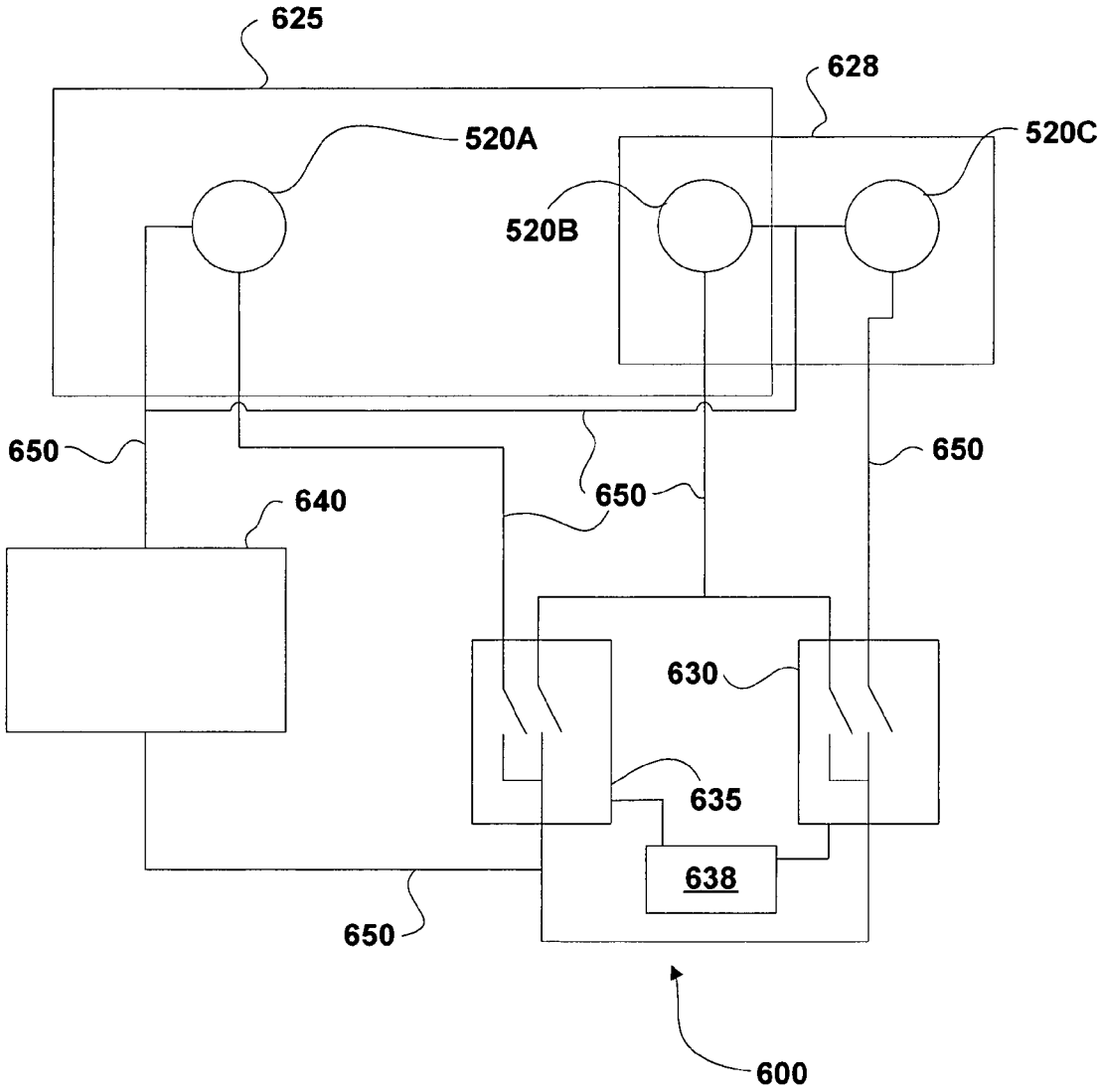
FIG. 6C illustrates an alternative embodiment of the electronic circuit wherein one bulb is a member of two bulb groups.

FIG. 6C illustrates an alternative embodiment of electronic circuit 600 wherein bulb 520B is a member of both bulb group 625 and bulb group 628. In this case, if either switch 630 or switch 635 is on then lamp 510B is lit.

In various embodiments bulb group 625 and bulb group 628 are disposed in useful patterns, such as those patterns illustrated in FIG. 3, meaningful to traffic control. In various embodiments of lamp 510 bulb group 625 and bulb group 628 are disposed in the same lamp 510 thus enabling a single lamp 510 to display a plurality of patterns meaningful to traffic control by selecting on or off states of switch 630 and switch 635.

FIG. 7 illustrates an embodiment of lamp 510 in which a filled circle and arrow are alternatively displayed. In FIG. 7 through FIG. 11, a circle 710 is used to indicate a bulb 520 that is a member of bulb group 625, a small triangle 720 (see FIG. 8A) is used to indicate a bulb 520 that is a member of bulb group 628, and a small square 730 is used to indicate a bulb 520 that is a member of both bulb group 625 and bulb group 628. These shapes are used for identification purposes only and are not meant to indicate a physical shape of any bulb 520. In addition, in all FIGs, a filled shape is used to indicate a lit bulb 520 and an empty shape is used to indicate an unlit bulb 520.

Figure 7A:
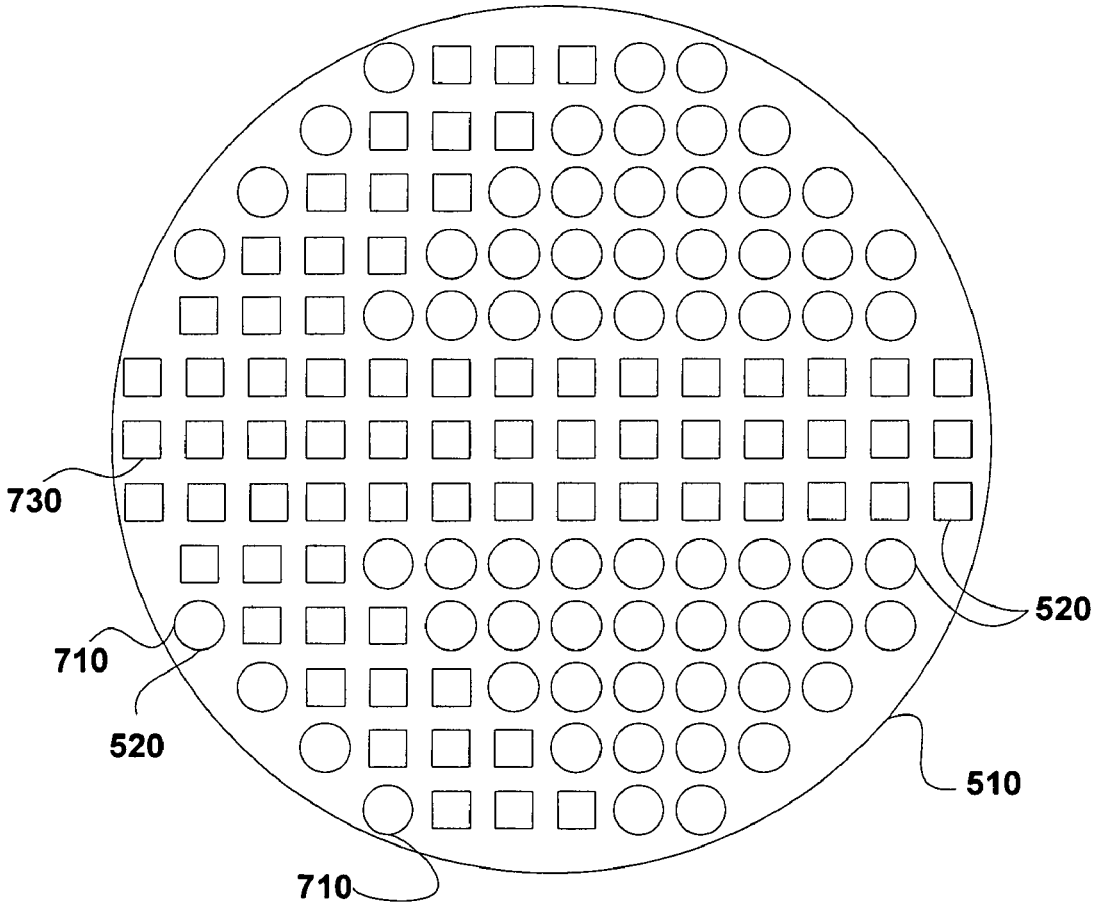
FIG. 7A illustrates a state of a lamp, according to an embodiment of the invention, wherein no bulb is lit.
Figure 7B:
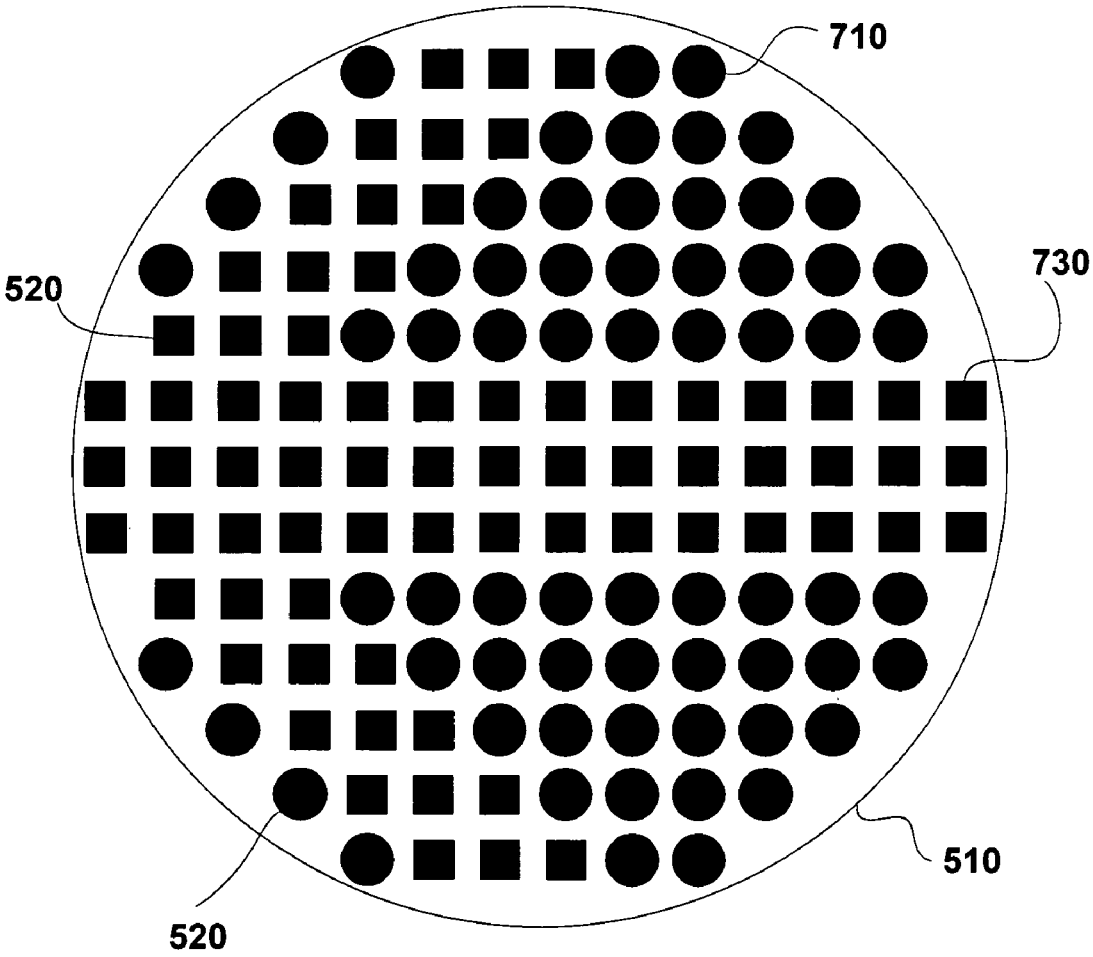
FIG. 7B illustrates a state of a lamp, according to an embodiment of the invention, wherein one bulb group is lit producing a pattern of a filled circle such as that found in a red stop lamp of a traffic signal.
Figure 7C:
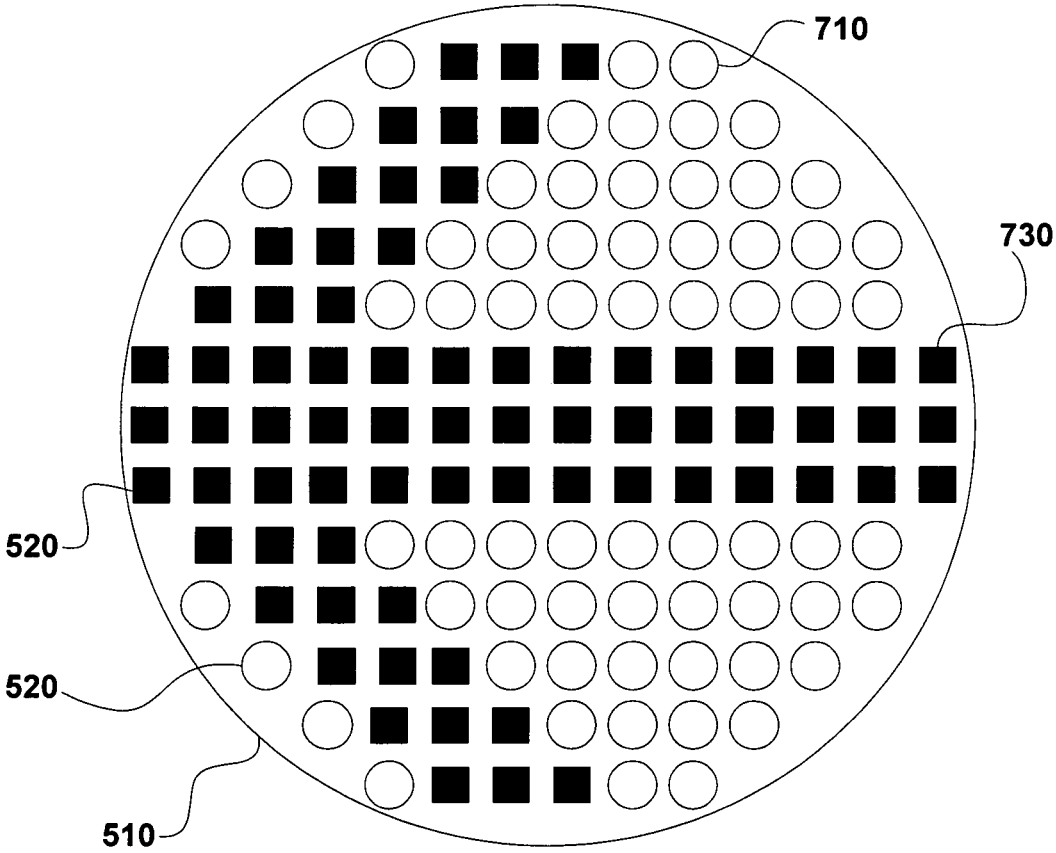
FIG. 7C illustrates a state of a lamp, according to an embodiment of the invention, wherein a bulb group is lit producing an image of an arrow such as that found in a red or green left turn lamp of a traffic signal.

FIG. 7A illustrates a state of lamp 510 wherein no bulb 520 is lit. FIG. 7B illustrates a state of lamp 510 wherein bulb group 625 is lit producing a pattern of a filled circle such as that found in a red stop lamp 510 of traffic signal 550. In this case all small circles 710 and small squares 730 representing bulb group 625 are filled. FIG. 7C illustrates a state of lamp 510 wherein bulb group 628 is lit producing an image of an arrow such as that found in a red or green left turn lamp 510 of a traffic signal 550. In this case all small squares representing bulb group 628 are filled (lit) but small circles representing bulb group 625 are not filled (unlit). The embodiment of lamp 510 shown in FIGS. 7A-7C displays an plurality of images using a single lamp 510 that, in the prior art, require a plurality of prior art lamp 110 to display. Bulb 520 is powered by a circuit, such as electronic circuit 600. Selection of the image displayed is made through switch 635, switch 630, or similar means. For example, in the embodiment shown illustrated in FIGS. 7A-7C and considering the embodiment of electronic circuit 600 shown in FIG. 6B, an arrow is displayed when switch 635 is on and a filled circle is displayed when switch 630 is also on. In the embodiment illustrated by FIGS. 7A-7C, where bulb group 628 is a subset of bulb group 625 the wiring of switch 635 and switch 630 is optionally serial, as shown in FIG. 6B, rather than in parallel. In most embodiments, each of bulb groups 625 and 628, within a specific lamp 510, includes one or more bulb 520 of essentially the same color. This enables a bulb 520 to be a member of more than one bulb group 625 or 628

Allowing an individual bulb 520 to be a member of more than one bulb group advantageously reduces the number of bulb 520, number of electrical connections, and the amount of supporting structure required. Traffic signal 550 maintains the expected positions of lamps 510 (red on bottom, green on top, etc. or left to right order) within traffic signal 550 while changing the patterns shown in each color. Maintaining standard positions allows the color of each lamp 510 to be deduced by viewers who are color blind. Allowing an individual bulb 520 to be a member of more than one bulb group 625 and 628 also allows alternative patterns to be presented with a number of bulb 520 less than the number that would be required to present both patterns with independent groups of bulbs.

Figure 8A:
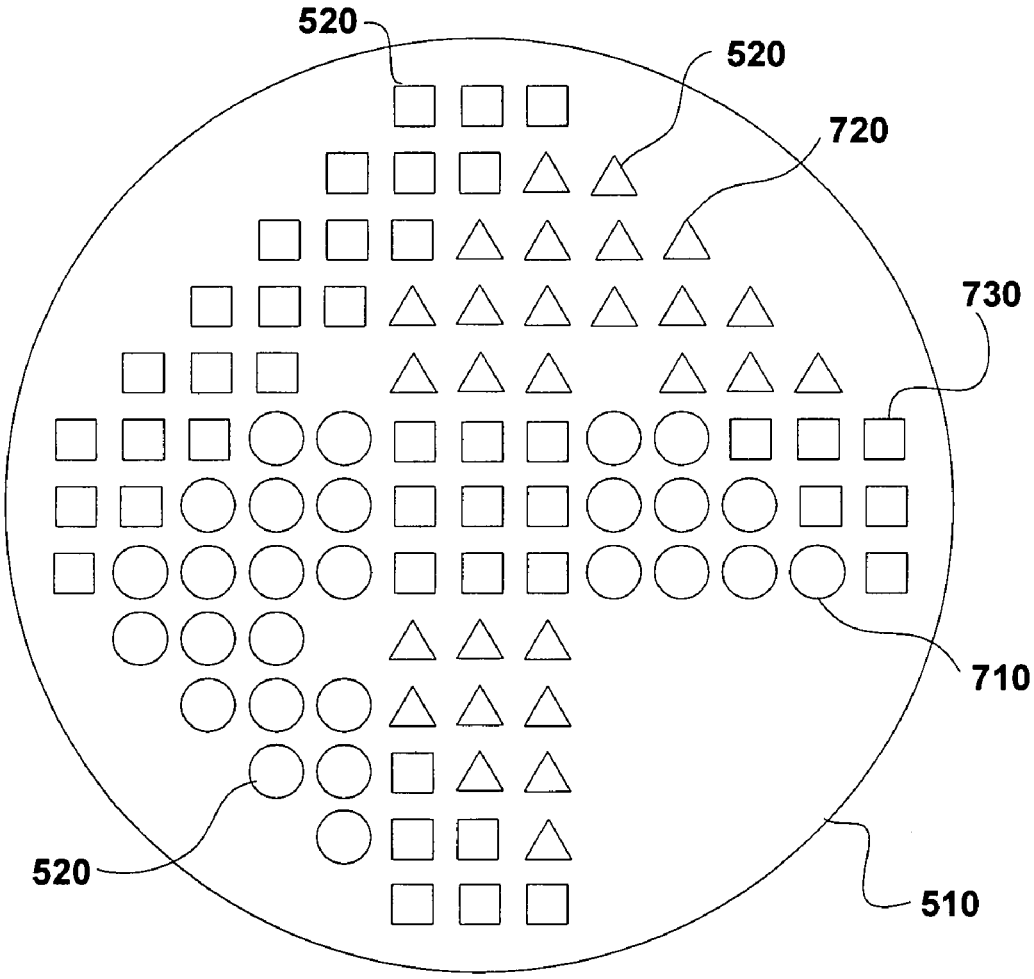
FIG. 8A illustrates an alternative embodiment of a lamp including a state in which two bulb groups are unlit.
Figure 8B:
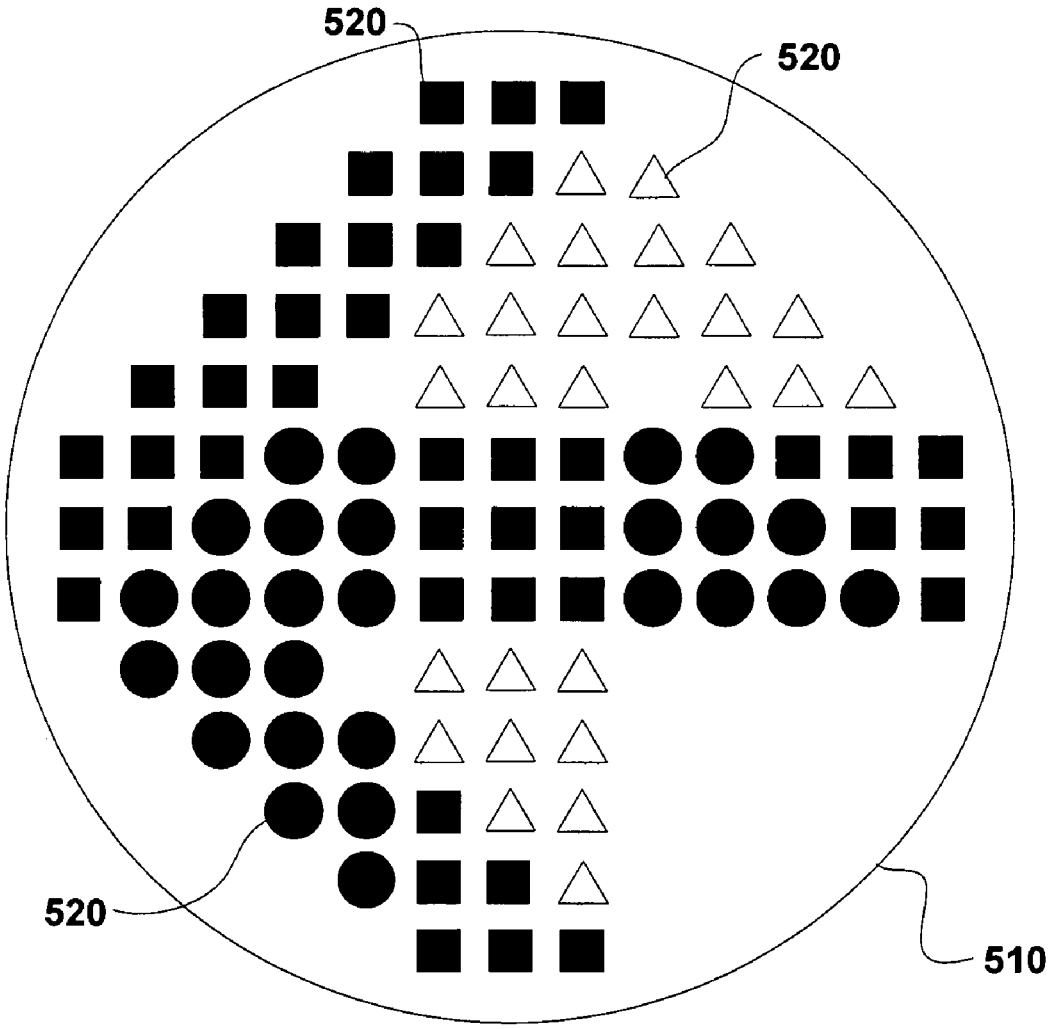
FIG. 8B illustrates an alternative embodiment of a lamp including a state in which a bulb group is lit and a bulb group is unlit.
Figure 8C:
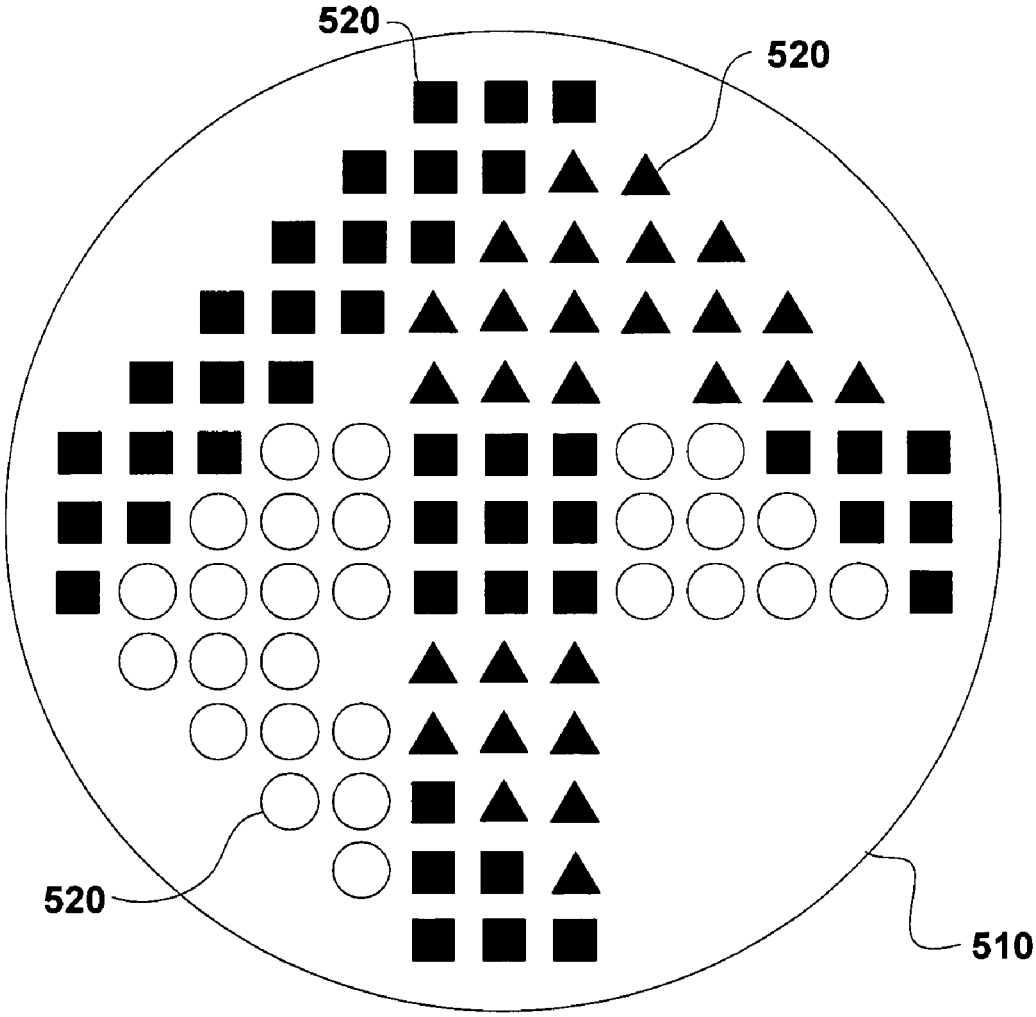
FIG. 8C illustrates an alternative embodiment of a lamp including a state in which a bulb group is unlit and a bulb group is lit.

FIGS. 8A-8C illustrate an alternative embodiment of lamp 510 in which bulb group 625 is not a subset of bulb group 628. This embodiment is controlled by a circuit such as the embodiment of electronic circuit 600 shown in FIG. 6C. FIG. 8A illustrates a state in which both bulb groups 625 and 628 are unlit. FIG. 8B illustrates a state in which bulb group 625 is lit and bulb group 628 is unlit. This state shows a solid arrow pointing to the left. FIG. 8C illustrates a state in which bulb group 625 is unlit and bulb group 628 is lit. This state shows a solid arrow pointing upward.

The embodiments illustrated by FIGS. 7 and 8 are illustrative. Bulb group 625 and bulb group 628 can each be arranged into any pattern meaningful to control traffic. Switch 635 and switch 630 are optionally included within traffic signal 550 or in a separate control module. More than two bulb groups are optionally included within a single lamp 510 and a plurality of lamp 510 is optionally included in traffic signal 550.

Figure 9:
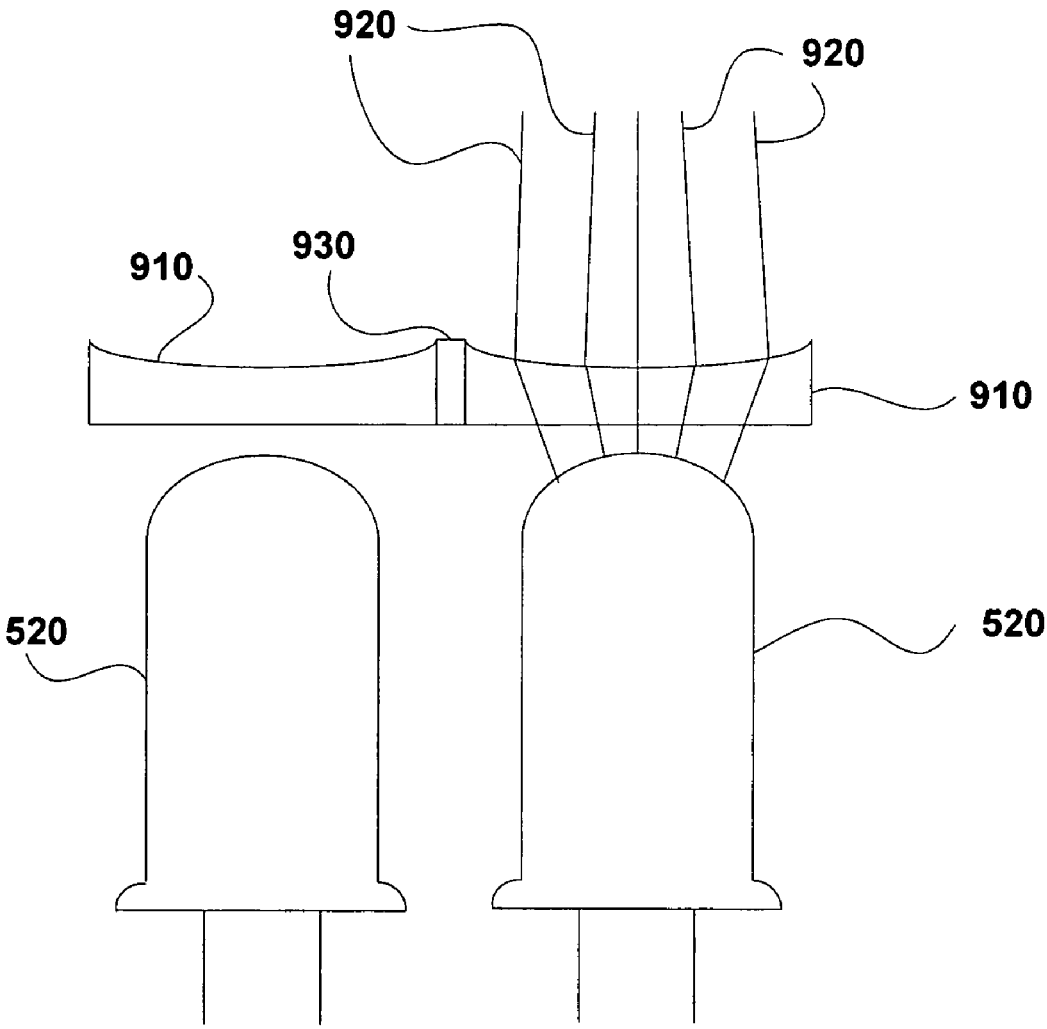
FIG. 9 illustrates an array of lenses, according to an embodiment of the invention, disposed to direct light generated by a bulb.

In one embodiment of the invention, illustrated by FIG. 9, a lens 910 is disposed to direct the light 920 generated by bulb 520. Each lens 910 directs the light of either one bulb 520 or a plurality of bulb 520. Lens 910 is included in an array of lenses 930 placed in front of an array of bulb 520. The direction that lens 910 directs the light of a bulb 520 is optionally a function of the bulb group 625 and/or 628 of which the bulb 520 is a member. Light generated by a member of bulb group 625 can, therefore, be directed in a direction different from light generated a member of bulb group 628. Array of lenses 930 optionally includes a lens for every bulb 520 in the array of bulb 520. Array of lenses 930 is optionally physically moved while traffic signal 550 is in operation in order to redirect the light of bulb 520. Since lens 910 is small and part of array of lenses 930, small movement (such as 1/10 of the width of bulb 520) results in a large change in the direction of light 920. This amount of movement is optionally accomplished by small solid state actuators.

Figure 10A:
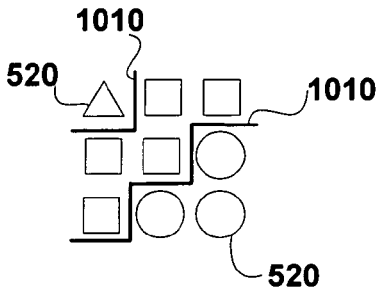
FIG. 10A illustrates an embodiment of a barrier wherein a minimal amount of the barrier is used to separate bulbs that are members of different bulb groups.
Figure 10B:
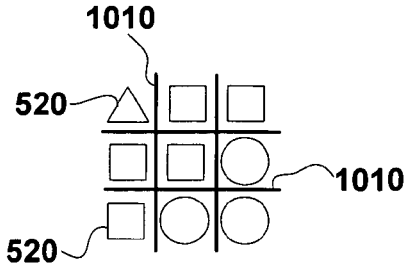
FIG. 10B illustrates an embodiment of a barrier wherein the barrier separates every bulb from every other bulb.
Figure 10C:
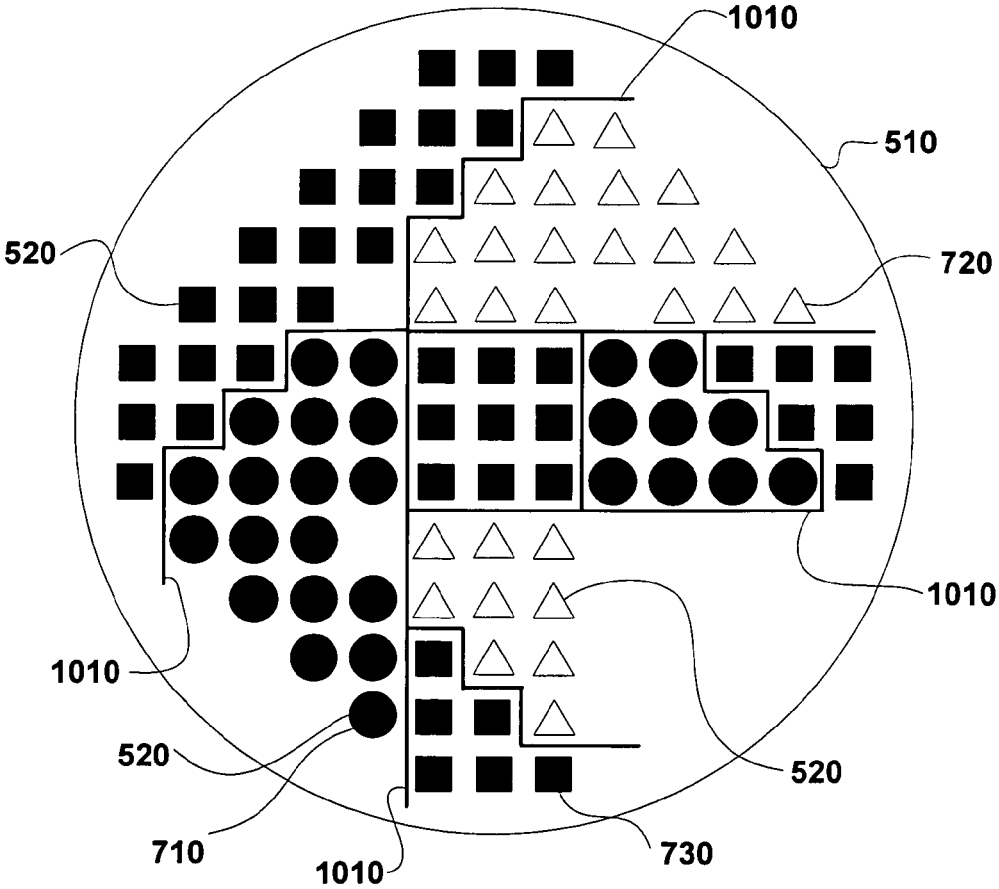
FIG. 10C illustrates an embodiment of a barrier wherein the barrier is used to separate bulbs that are members of different bulb groups, in a lamp illustrated in FIGS. 7A-7C

In one embodiment, illustrated in FIGS. 10A-10C, bulbs 520 that are members of only bulb group 625 are separated from bulbs 520 that are members of bulb group 628, by a barrier 1010 disposed to prevent light emitted from a member of bulb group 625 from striking and then scattering from a member of bulb group 628. Since light, first produced by a member of bulb group 625, is prevented from scattering from a member of bulb group 628 the visual separation between bulb groups 625 and 628 is enhanced. Barrier 1010 is preferably opaque or semi-opaque and can be a variety of shapes other than those shown in FIGS. 10A-10C. Barrier 1010 is optionally disposed to support bulb 520 and/or lens 910. FIG. 10A illustrates an embodiment of barrier 1010 wherein a minimal amount of barrier 1010 is used to separate bulb 520 that are members of different bulb groups 625 and 628. FIG. 10B illustrates an embodiment of barrier 1010 wherein barrier 1010 separates every bulb 520 from every other bulb 520. FIG. 10C illustrates an embodiment of barrier 1010 wherein barrier 1010 is used to separate bulb 520 that are members of different bulb groups 625 and 628, in the lamp 510 illustrated in FIGS. 7A-7C.

Figure 11A:
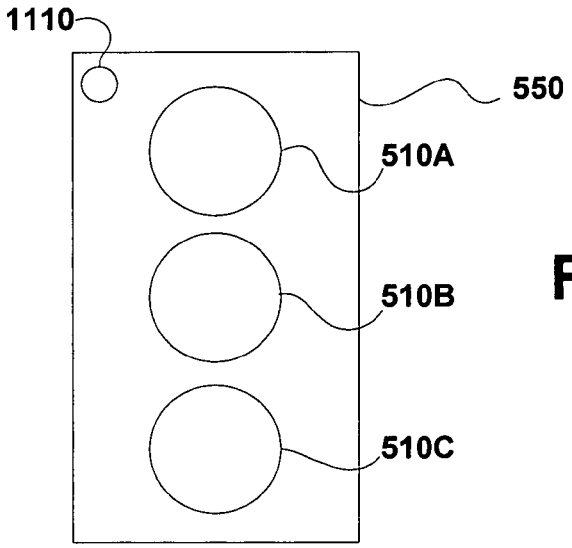
FIG. 11A illustrates an embodiment of a traffic signal including a photo-sensor used to regulate the brightness of a lamp.
Figure 11B:
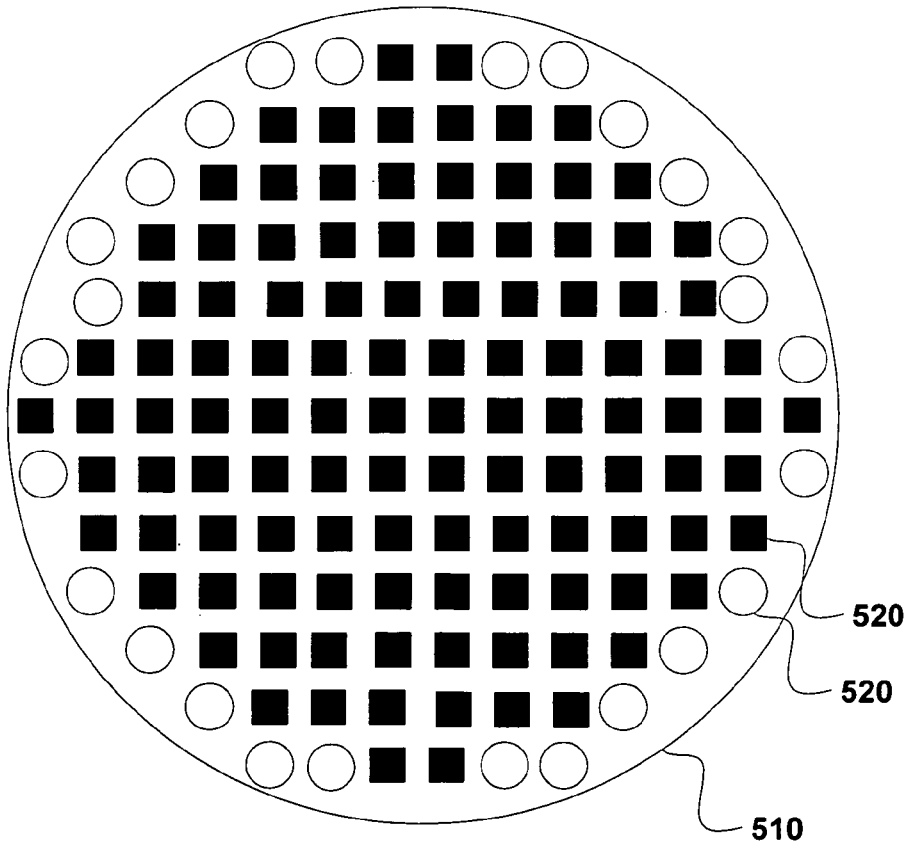
FIG. 11B illustrates how the brightness of a lamp is reduced, while still maintaining an image pattern shown by the lamp, by not lighting every fifth bulb used to produce the image pattern.

FIG. 11A illustrates an embodiment of traffic signal 550 including a photo-sensor 1110 used to regulate the brightness of lamp 510. The brightness of lamp 510 is regulated in response to ambient light detected by photo-sensor 1110 and is controlled by changing the brightness of bulb 520 and/or changing the number of bulb 520 within lamp 510 that are lit, in a lit state of lamp 510. For example, in one embodiment the brightness of a lamp 510 is reduced by not lighting twenty percent of the bulb 520 within lamp 510. This is accomplished, as shown in FIG. 11B, while still maintaining the meaning of the image pattern shown by lamp 510, by not lighting every fifth bulb 520 used to produce the image pattern. In this embodiment, the every fifth bulb 520 not lit is a member of bulb group 625 and the remaining bulbs are members of both bulb groups 625 and 628. Photo-sensor 1110 faces either the back or front of traffic signal 550 and detects the amount of light striking the front or back of traffic signal 550 respectively. In one embodiment photo-sensor 1110 faces the back of traffic signal 550 and increases the brightness of lamp 510 when bright light, such as sunlight, is striking the back of traffic signal 550 at an angle that makes viewing of lamp 510 difficult. The increase in brightness compensates for the difficulty in viewing and, therefore, increases the utility of traffic signal 550. Shielding (not shown) is used to make photo-sensor 1110 sensitive to an angle of incidence of the bright light striking traffic signal 550. Use of photo-sensor 1110 and shielding for brightness control is not limited to lamp 510. They are optionally also used to control the intensity of prior art lamp 110 by regulating the current or voltage that are provide to these lamps.

Embodiments of the invention include means for attracting attention to a traffic signal 550. Since individual bulbs 520 within lamp 510 are optionally separately controllable, a subset of bulb 520, including at least two bulb 520 and forming part of an image, is optionally turned on and off to attract attention to lamp 510 without changing the meaning of the displayed pattern. The bulbs turned on an off may comprise a bulb group, such as bulb group 625. For example, in one embodiment, in an image of a solid circle the bulbs 520 on the outer edge of the circle image are turned on an off rapidly. This action draws attention to the image while still enabling the display of a continuous solid circle shape, as shown in FIG. 11B. In alternative embodiments, the bulbs turned on and off are disposed in other positions within the filled circle. In an alternative embodiment the bulbs turned on and off are within a bulb group and are turned on and off in a sequential manner.

Figure 12:
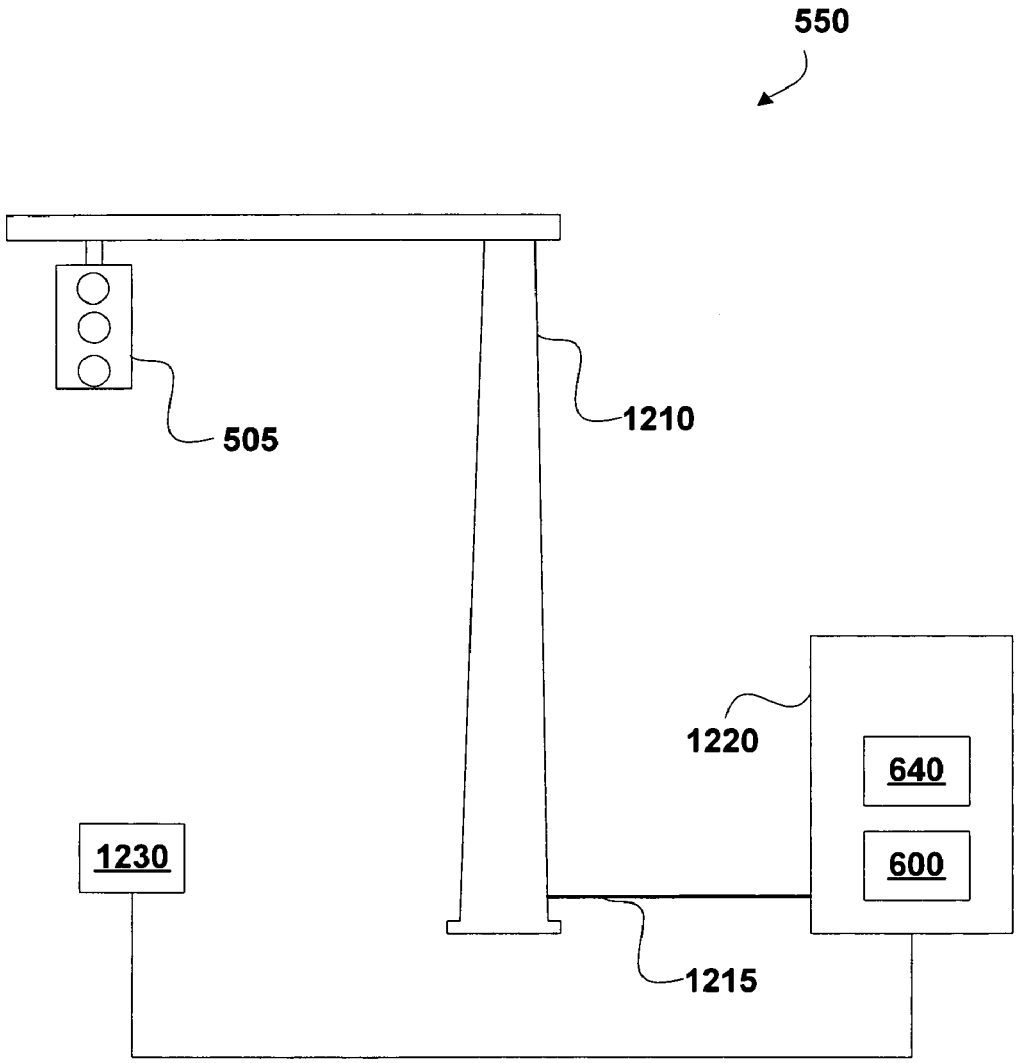
FIG. 12 illustrates an embodiment of a traffic signal supported by a support structure.

As shown in FIG. 12, an embodiment of traffic signal 550 includes a support structure 1210 configured to support one or more housing 505. Support structure 1210 is optionally electronically 1215 coupled to other support structure and housing 505 (not shown) and to an electronic console 1220 included in some embodiments of traffic signal 550. Support structure 1210 supports housing 505 and includes elements such as bars, tubes, wires, bridges, signs, poles, and the like. Electronic circuit 600 and/or power source 640 for powering each traffic signal 550 is optionally included in electronics console 1220. An intersection involving multiple flows of traffic is optionally controlled using a plurality of housing 505. The invention enables a reduction in the number of lamp 510 within each traffic signal and thus enables the used of support structure 1210 that can support less weight. Electronic console 1220 is optionally coupled to and responsive to a traffic sensor 1230 configured to determine the volume or flow of traffic. For example the traffic sensor is optionally used to determine the lit/unlit state of bulb group 625.

Figure 13:
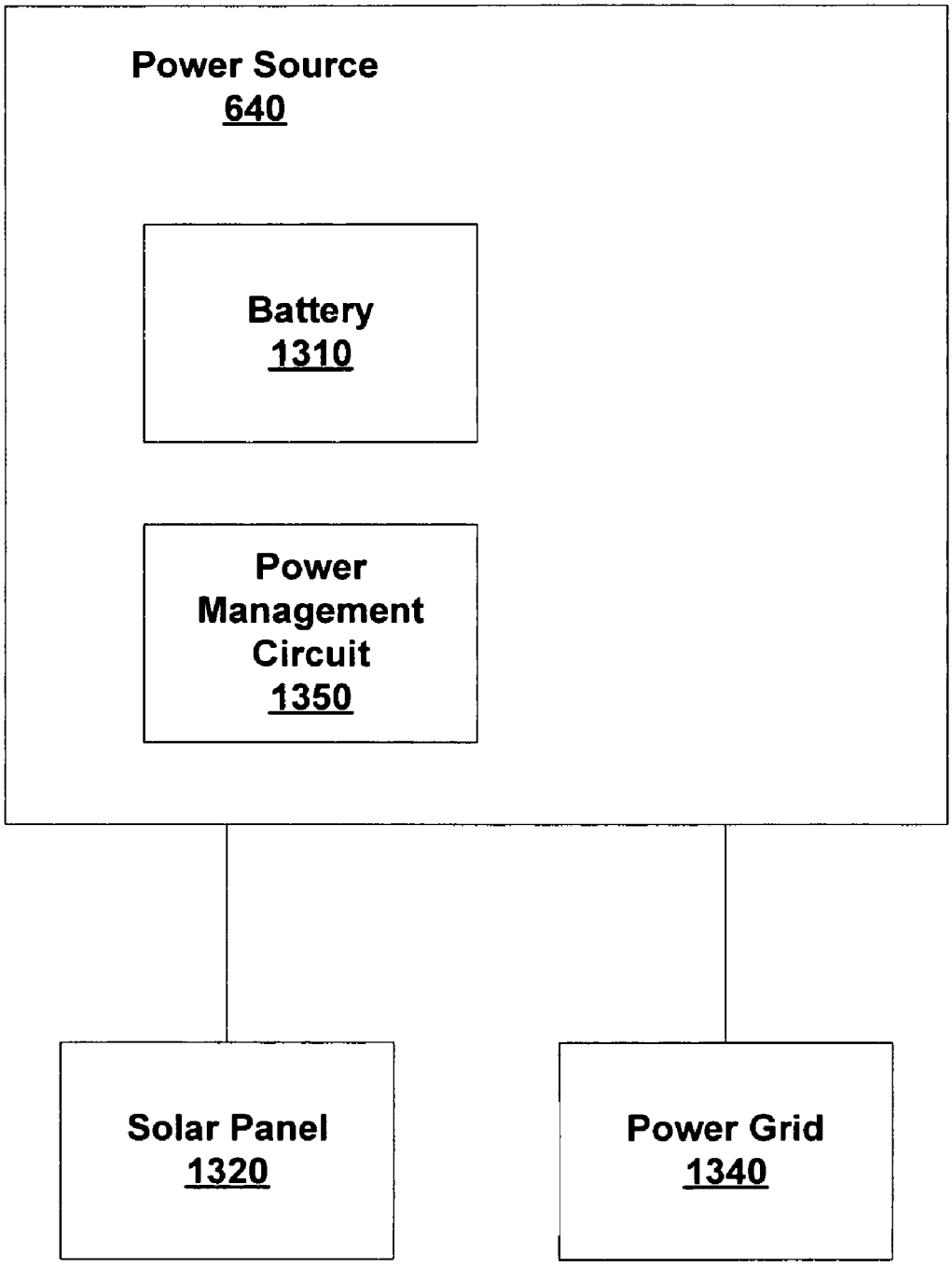
FIG. 13 illustrates an embodiment of a power source including a power management circuit, and a battery to provide power when other power sources are not available.

In one embodiment, illustrated by FIG. 13, power source 640 includes a power management circuit 1350, and a battery 1310 to provide power when other power sources are not available. Battery 1310 is charged by either a solar panel 1320 or an AC power grid 1340, when these sources are available to supply power. In the event of a failure in power grid 1340, battery 1310 provides backup power. Solar panel 1320 is optionally mounted on support pole 1210.

Power management circuit 1350 is used to conserve the power used by traffic signal 550 and to extend battery 1310 lifetime. Power management is responsive to the availability of power from power grid 1340 or an external signal such as a radio message. Power management circuit 1350 includes control of switches 630 and/or 635 enabling the power management circuit 1350 to turn off a bulb group 625 or 628 in order to conserve power. As shown in FIG. 11, in one embodiment one bulb group 625 or 628 can be turned off without changing the meaning of the pattern displayed. Power is alternatively conserved by regulating the current or voltage to a lamp 510. When voltage or current regulation is used, power management is optionally applied, by power management circuit 1350, to prior art lamps 110. In one embodiment the brightness of a prior art lamp 110 is reduced using power management circuit 1350 to conserve power and/or extend the lifetime of battery 1310.

In various embodiments the patterns displayed by lamp 510 are functions of additional factors such as the time of day, the day of the week, and traffic volume/flow detected by traffic sensor 1230. For example, in one embodiment, during a period of peak traffic volume, a pattern of a red left turn arrow 310 is displayed while at the same time another lamp 510 in the same traffic signal 550 displays a green up arrow. This state of traffic signal 550 indicates that traffic may move forward but left turns are not allowed. During a period of reduced traffic the same traffic signal 550 displays only a green filled circle indicating that traffic is allowed to move forward and also make a left turn.

Figure 14A:
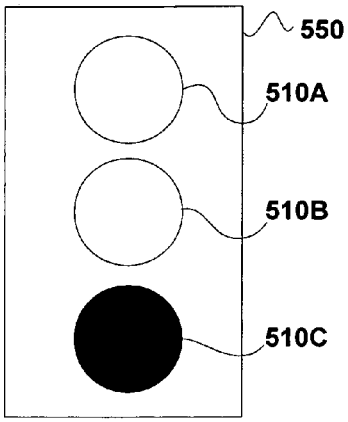
FIG. 14A illustrates a state of a traffic signal including an unlit red lamp, an unlit yellow lamp, and a lit green lamp with a pattern of a filled circle.
Figure 14B:
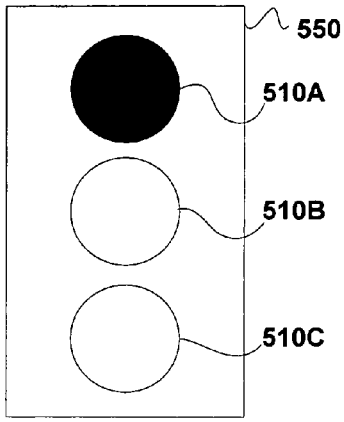
FIG. 14B illustrates a state of a traffic signal including a lit red lamp with a pattern of a filled circle, an unlit yellow lamp, and an unlit green lamp.
Figure 14C:
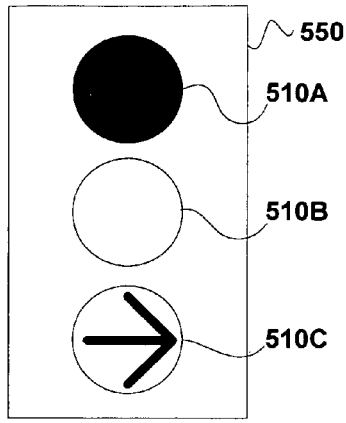
FIG. 14C illustrates a state of a traffic signal including a lit red lamp with a pattern of a filled circle, an unlit yellow lamp, and a lit green lamp with a pattern of a right arrow.
Figure 14D:
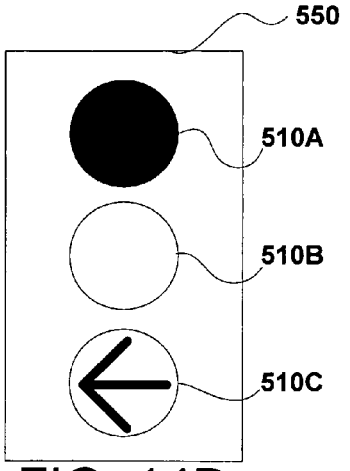
FIG. 14D illustrates a state of a traffic signal including a lit red lamp with a pattern of a filled circle, an unlit yellow lamp, and a lit green lamp with a pattern of a left arrow.
Figure 14E:
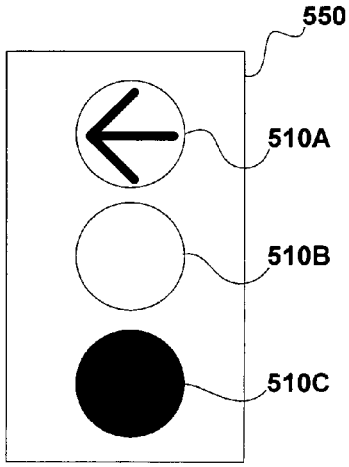
FIG. 14E illustrates a state of a traffic signal including a lit red lamp with a pattern of a left arrow, an unlit yellow lamp, and a lit green lamp with a pattern of a filled circle.
Figure 14F:
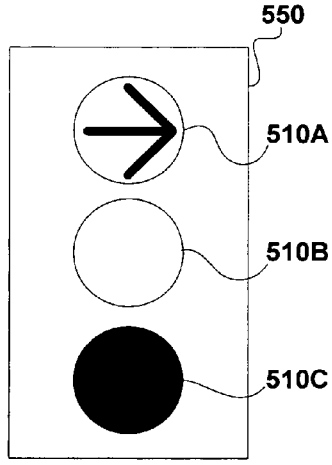
FIG. 14F illustrates a state of a traffic signal including a lit red lamp with a pattern of a right arrow, an unlit yellow lamp, and a lit green lamp with a pattern of a filled circle.
Figure 14G:
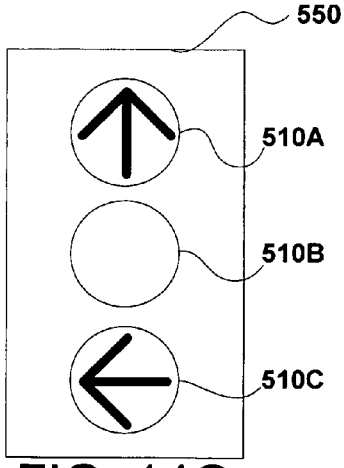
FIG. 14G illustrates a state of a traffic signal including a lit red lamp with a pattern of a up arrow, an unlit yellow lamp, and a lit green lamp with a pattern of a left arrow.
Figure 14H:
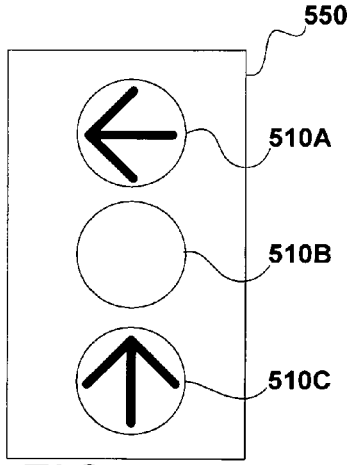
FIG. 14H illustrates a state of a traffic signal including a lit red lamp with a pattern of an left arrow, an unlit yellow lamp, and a lit green lamp with a pattern of an up arrow.
Figure 14I:
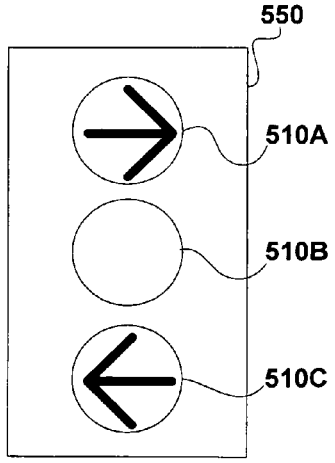
FIG. 14I illustrates a state of a traffic signal including a lit red lamp with a pattern of a right arrow, an unlit yellow lamp, and a lit green lamp with a pattern of a left arrow.

Examples of states of traffic signal 550 are illustrated by FIGS. 14A through 14K. Embodiments of traffic signal 550 are optionally configured to operate in any two or more of these states. The state shown in FIG. 14A includes an unlit red lamp 510A, an unlit yellow lamp 510B, and a lit green lamp 510C with a pattern of a filled circle. The state shown in FIG. 14B includes a lit red lamp 510A with a pattern of a filled circle, an unlit yellow lamp 510B, and an unlit green lamp 510C. The state shown in FIG. 14C includes a lit red lamp 510A with a pattern of a filled circle, an unlit yellow lamp 510B, and a lit green lamp 510C with a pattern of a right arrow. The state shown in FIG. 14D includes a lit red lamp 510A with a pattern of a filled circle, an unlit yellow lamp 510B, and a lit green lamp 510C with a pattern of a left arrow. The state shown in FIG. 14E includes a lit red lamp 510A with a pattern of a left arrow, an unlit yellow lamp 510B, and a lit green lamp 510C with a pattern of a filled circle. The state shown in FIG. 14F includes a lit red lamp 510A with a pattern of a right arrow, an unlit yellow lamp 510B, and a lit green lamp 510C with a pattern of a filled circle. The state shown in FIG. 14G includes a lit red lamp 510A with a pattern of a up arrow, an unlit yellow lamp 510B, and a lit green lamp 510C with a pattern of a left arrow. The state shown in FIG. 14H includes a lit red lamp 510A with a pattern of an left arrow, an unlit yellow lamp 510B, and a lit green lamp 510C with a pattern of an up arrow. The state shown in FIG. 14I includes a lit red lamp 510A with a pattern of a right arrow, an unlit yellow lamp 510B, and a lit green lamp 510C with a pattern of a left arrow. The state shown in FIG. 14I is possibly used at a "T" intersection. The state shown in FIG. 14J includes an unlit red lamp 510A, an unlit yellow lamp 510B, and a lit green lamp 510C with a pattern of a left arrow. The state shown in FIG. 14K includes a lit red lamp 510A with a pattern of a left arrow, an unlit yellow lamp 510B, and an unlit green lamp 510C. Alternative states (not shown) include displaying patterns in yellow lamp 510B, states designed to reduce power consumption, and states including flashing bulbs 520. Alternative states (not shown) include lamps 510 configured to display cross patterns, bar patterns, "T" patterns, polygon patterns (e.g. square, triangle, hexagon etc.) or the like. Some embodiments of housing 550 include no lamps configured to display numbers or letters of the English alphabet.

All of the states of lamp 510 discussed herein occur in embodiments of traffic signal 550 that include one or more lamp 510. Similar states occur in embodiments of traffic signal 550 including a combination of lamp 510 and lamp 110. Similar states also occur in embodiments of traffic signal 550 that include at least one lamp 510 and a total of more than three lamps including lamp 510 or lamp 110.

Figure 14J:
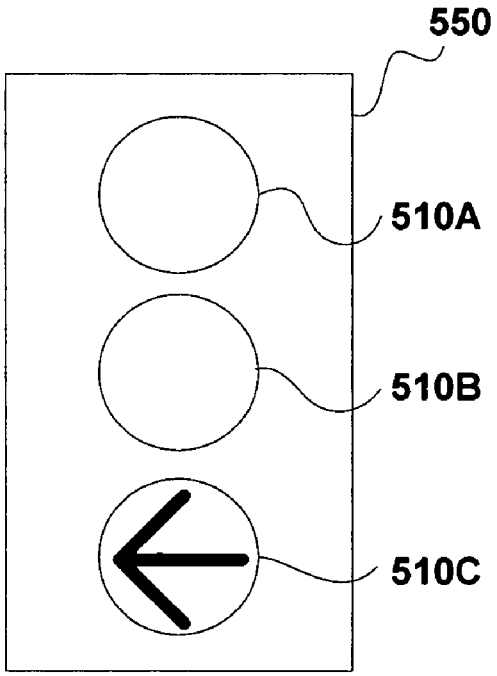
FIG. 14J illustrates a state of a traffic signal including an unlit red lamp, an unlit yellow lamp, and a lit green lamp with a pattern of a left arrow.
Figure 14K:
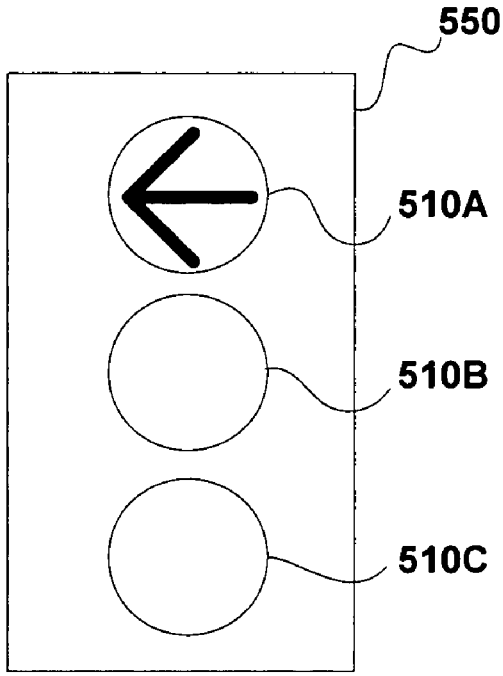
FIG. 14K illustrates a state of a traffic signal including a lit red lamp with a pattern of a left arrow, an unlit yellow lamp, and an unlit green lamp.
Figure 15:
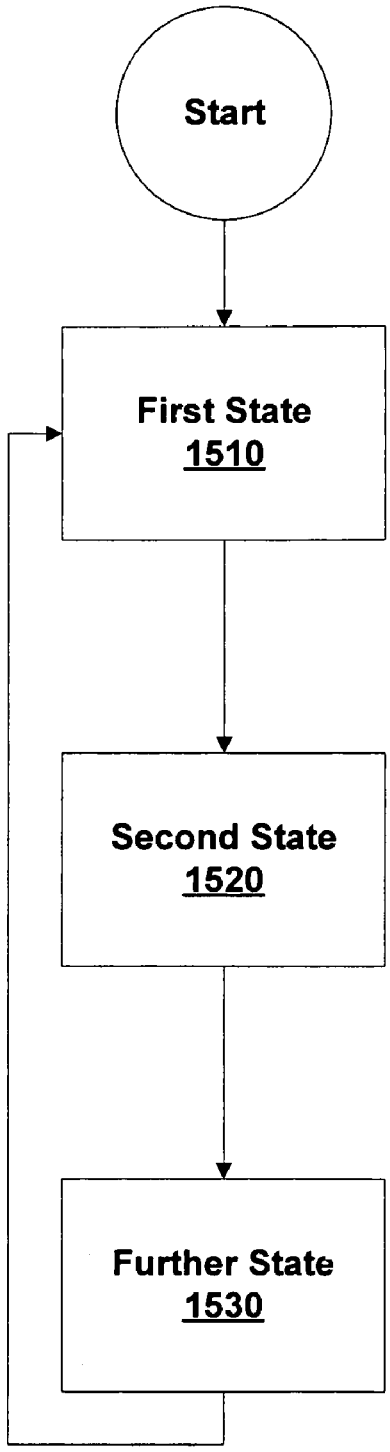
FIG. 15 illustrates an embodiment of a method of the invention.

FIG. 15 illustrates an embodiment of a method of the invention. In a first step 1510 a first state of traffic signal 550 is displayed. The first state can be any of the states possible for traffic signal 550, such as those illustrated in FIG. 14, or the like. In a second step 1520 a second state of traffic signal 550 is displayed. The second state can be any of the states possible for traffic signal 550, or the like, other than the first state. The method optionally includes displaying one or more further state of traffic signal 550 in a step 1530. Displaying the first state of step 1510 and the second state of step 1520 includes using an individual lamp 510 to display at least two different patterns. In one embodiment, the first state and the second state include the use of a specific lamp 510 to display more than one pattern. An example of this embodiment is found when the first and second state are illustrated by FIGS. 14A and 14J respectively. In another embodiment traffic signal includes three lamps including at least one lamp 510, wherein at least two of the three lamps are lit in the first state. An example of this embodiment is illustrated in FIG. 14E.

The identity of first state and second state optionally changes responsive to the time of day, the day of the week, the traffic load as detected by traffic sensor 1230, light detected by photo-sensor 1110, the status of power source 640, or the like.

In Traffic Signal 550, electronic console 1220 sometimes includes a first electrical output configured for displaying one pattern in lamp 510 of housing 505, and a second electrical output configured displaying a second pattern therein. (In prior systems the first electrical output and the second electrical output are electrically coupled to different instances of prior art lamp 110 in order to display these patterns.) For example, in some embodiments of the invention, the first and second electrical outputs are connected to one instance of housing 505 by two wires electrically isolated from each other and each terminating in a separate plug/socket. (The term plug/socket is used herein to refer to either a plug or a socket or a Conductor that is neither male nor female. That these types of Conductors could be varied in different embodiments of the invention is clear to anyone familiar with the art of electrical Conductors.) In some embodiments, Bulb Groups 625 and 628 are disposed within a bulb assembly configured to receive the above first electrical output and second electrical output from a control system, such as electronic console 1220. In these embodiments, the display of various patterns within an instance of lamp 510 are controllable using as few as two hot inputs and at least one neutral (e.g., ground) connection. These embodiments may be advantageous in that they provide compatibility with prior art control systems and traffic signal wiring.

Figure 16A:
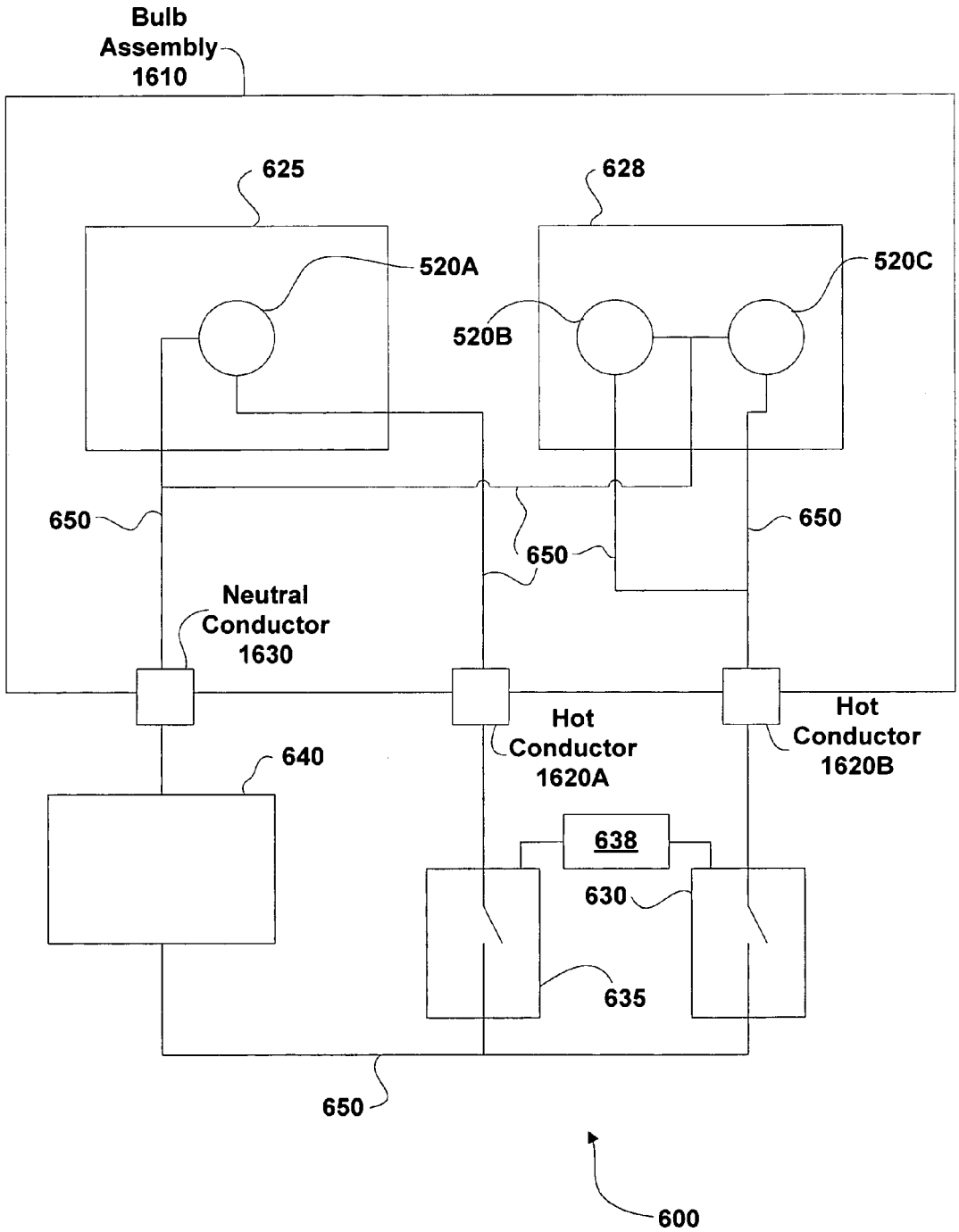
FIG. 16A illustrates an electronic circuit configured to separately control a plurality of bulbs, and indicates those circuit elements that are included in a Bulb Assembly according to some embodiments of the invention.

FIG. 16A illustrates an electronic circuit configured to separately control a plurality of bulb groups, and indicates those circuit elements that are included in a Bulb Assembly 1610 according to some embodiments of the invention. Bulb Assembly 1610 includes at least a First Hot Conductor 1620A, a Second Hot Conductor 1620B and a Neutral Conductor 1630. Typically, First Hot Conductor 1620A, Second Hot Conductor 1620B and Neutral Conductor 1630 are configured for attachment to wiring within Traffic Signal 550 such that they are electrically coupled to outputs of electronic console 1220. For example, First Hot Conductor 1620A, Second Hot Conductor 1620B and Neutral Conductor 1630 may be included in one or more plug/sockets. In some embodiments, Bulb Assembly 1610 includes further hot Conductors, neutral Conductors and/or ground Conductors.

Figure 16B:
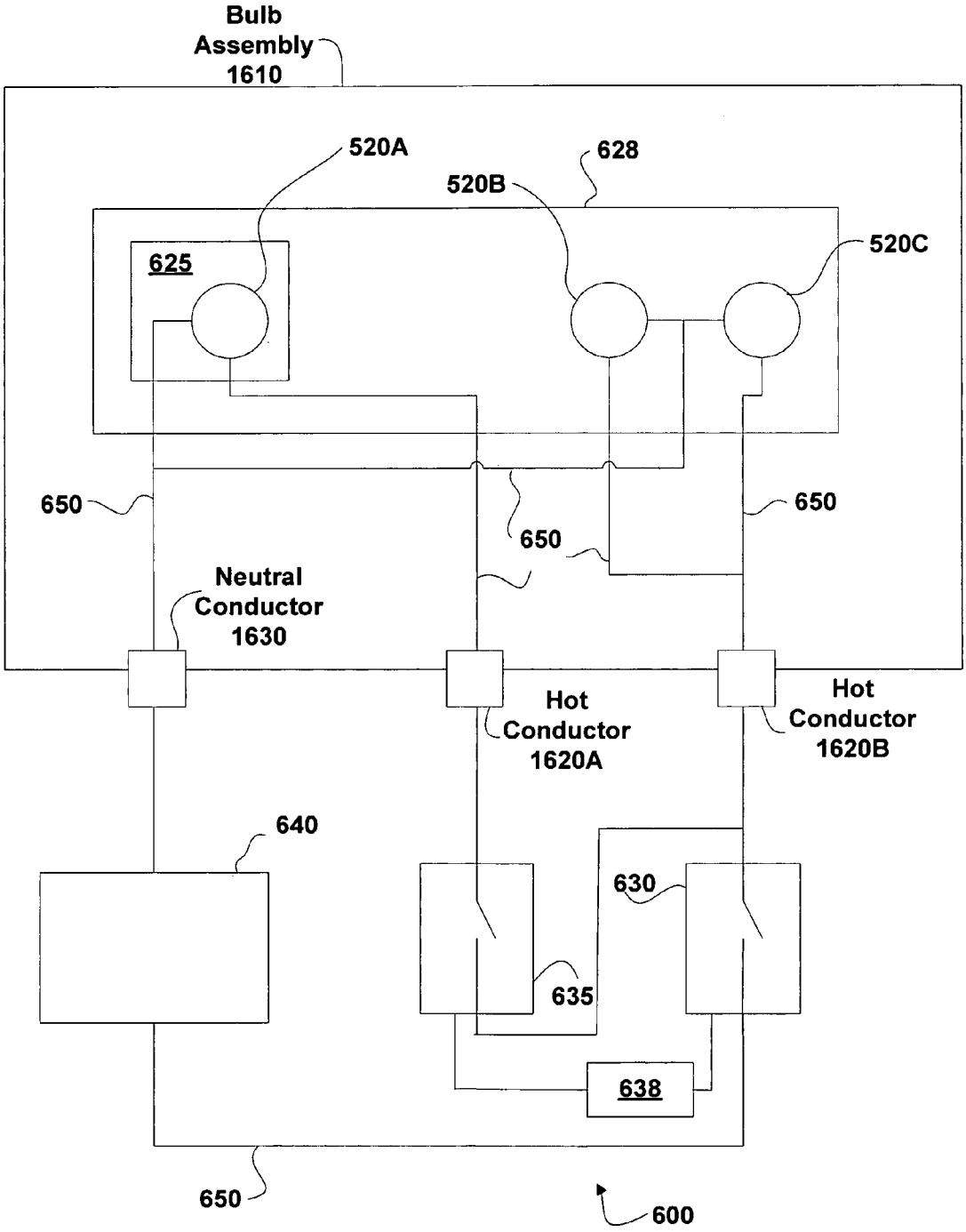
FIG. 16B illustrates an alternative embodiment of the electronic circuit in which two bulb groups are wired in series instead of in parallel, and indicates those circuit elements that are included in a Bulb Assembly, according to some embodiments of the invention.

FIG. 16B illustrates an alternative embodiment of the electronic circuit in which two bulb groups are wired in series instead of in parallel, and indicates those circuit elements that are included in Bulb Assembly 1610 according to some embodiments of the invention. In the circuit shown both switches 630 and 635 must be on (closed) in order to power all of Bulb Group 628. This may cause some incompatibilities with prior art control systems. In some embodiments, these incompatibilities may be overcome as discussed with respect to FIG. 18B.

Figure 16C:
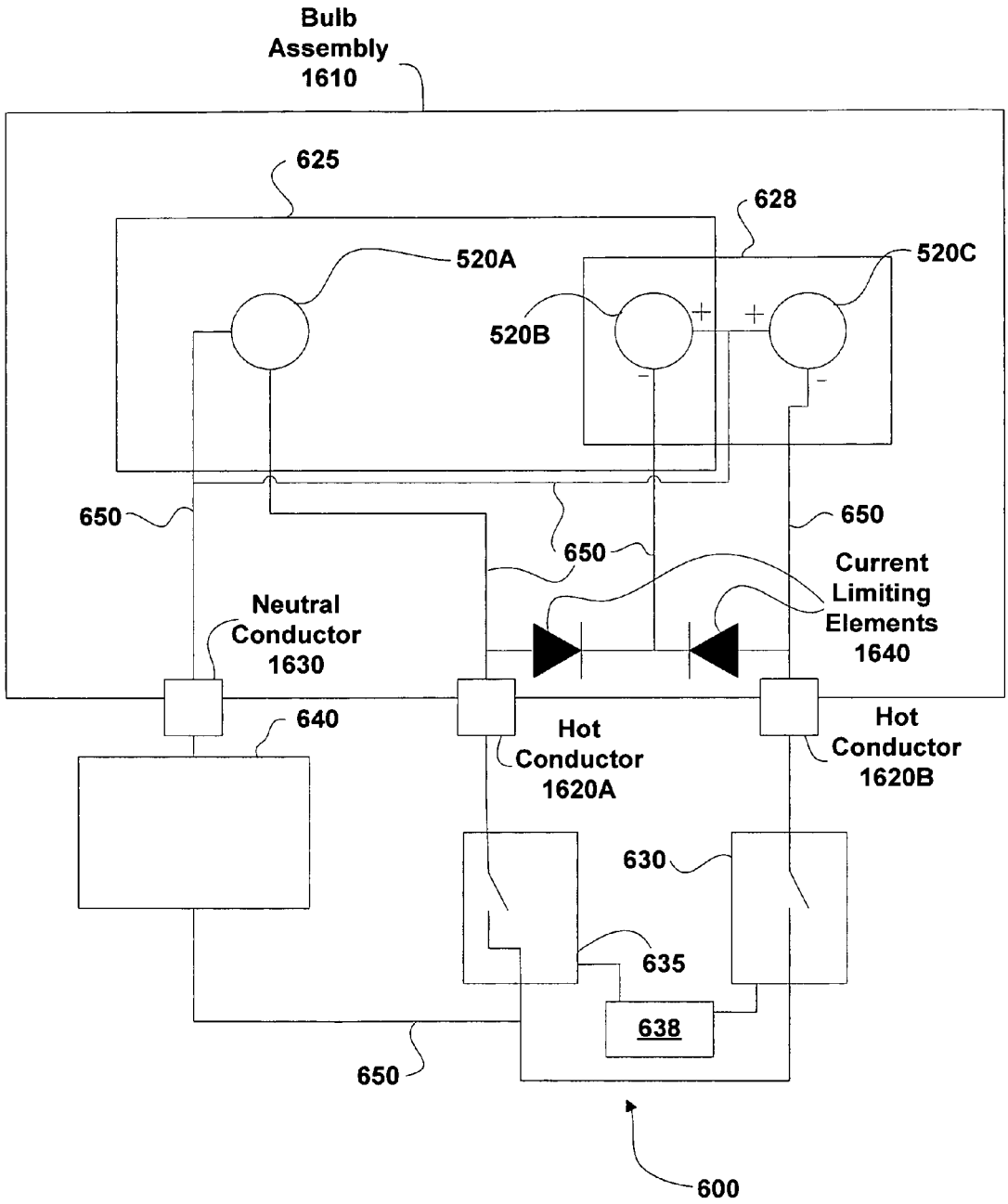
FIG. 16C illustrates an alternative embodiment of the electronic circuit wherein one bulb is a member of two bulb groups, and indicates those circuit elements that are included in a Bulb Assembly, according to some embodiments of the invention.

FIG. 16C illustrates an alternative embodiment of the electronic circuit wherein one bulb is a member of two bulb groups, and indicates those circuit elements that are included in Bulb Assembly 1610 according to some embodiments of the invention. In these embodiment, Bulb Assembly 1610 include one or more Current Limiting Components 1640. Current Limiting Components 1640 may include diodes, resisters, transistors, digital electronics, silicon controlled rectifiers, logic circuits, transformers, or the like. In some embodiments, Current Limiting Components 1640 are configured such that Bulb Groups 625 and 628 are separately controllable using First Hot Conductor 1620A and Second Hot Conductor 1620B, even when Bulb Groups 625 and 628 include at least one of the LEDs (e.g., bulbs 520A-520C) in common.

For example, in some embodiments, Current Limiting Components 1640 are configured such that when voltage is applied to the first hot electrical Conductor 1620A but not the second hot electrical Conductor 1620B only LEDs included in Bulb Group 625 are turned on, and when voltage is applied to the second hot electrical Conductor 1620B but not the first hot electrical Conductor 1620A only LEDs included Bulb Group 628 are turned on. In some embodiments, Current Limiting Components 1640 are configured such that when voltage is applied to the first hot electrical Conductor 1620A but not the second hot electrical Conductor 1620B only LEDs included in Bulb Group 625 are turned on, and when voltage is applied to the second hot electrical Conductor 1620B but not the first hot electrical Conductor 1620A LEDs included in both Bulb Groups 625 and 628 are turned on. In some embodiments, Current Limiting Components 1640 are configured such that when voltage is applied to the first hot electrical Conductor 1620A but not the second hot electrical Conductor 1620B only LEDs included in the first set of LEDs are turned on, and when voltage is applied to the second hot electrical Conductor LEDs included in both Bulb Groups 625 and 628 are turned on. In alternative embodiments, Current Limiting Components 1640 are further configured to control the current and or voltage applied to member of Bulb Groups 625 or 628.

In some embodiments, the polarity of one or more members or Bulb Groups 625 or 628 are configured match one or more polarity of Current Limiting Components 1640. An example of polarity matching is included in FIG. 16C.

Figure 17A:
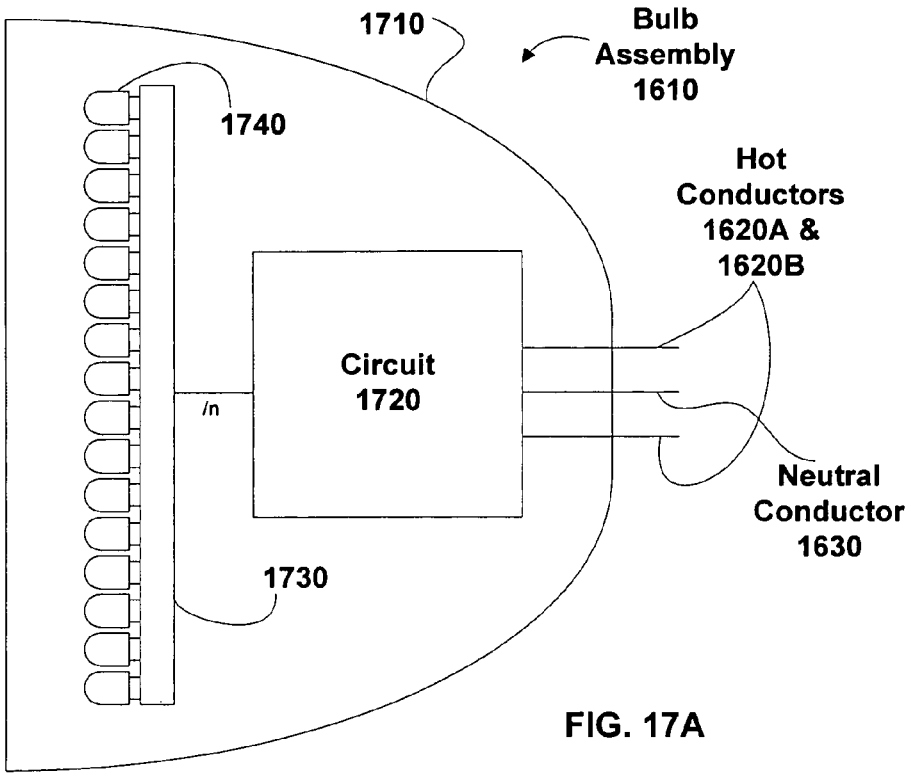
FIG. 17A illustrates a cross-section of a Bulb Assembly including LEDs, a housing, a circuit, and three Conductors, according to various embodiments of the invention.

Various embodiments of the invention include a variety of ways in which Bulb Assembly 1610 may be configured. For example, FIG. 17A illustrates a cross-section of a Bulb Assembly 1610 including LEDs 1740, a Housing 1710, a Circuit 1720, an LED Support 1730, First and Second Hot Conductors 1620A and 1620B, and Neutral Conductor 1630, according to various embodiments of the invention. LEDs 1740 include at least Bulb Groups 625 and 628. Housing 1710 is option and may be glass, plastic or the like. Circuit 1720 includes electrical connections 650 and optionally Current Limiting Components 1640. LED Support 1730 is configured to support LEDs 1740 and typically to mechanically couple LEDs 1740 to a base.

Figure 17B:
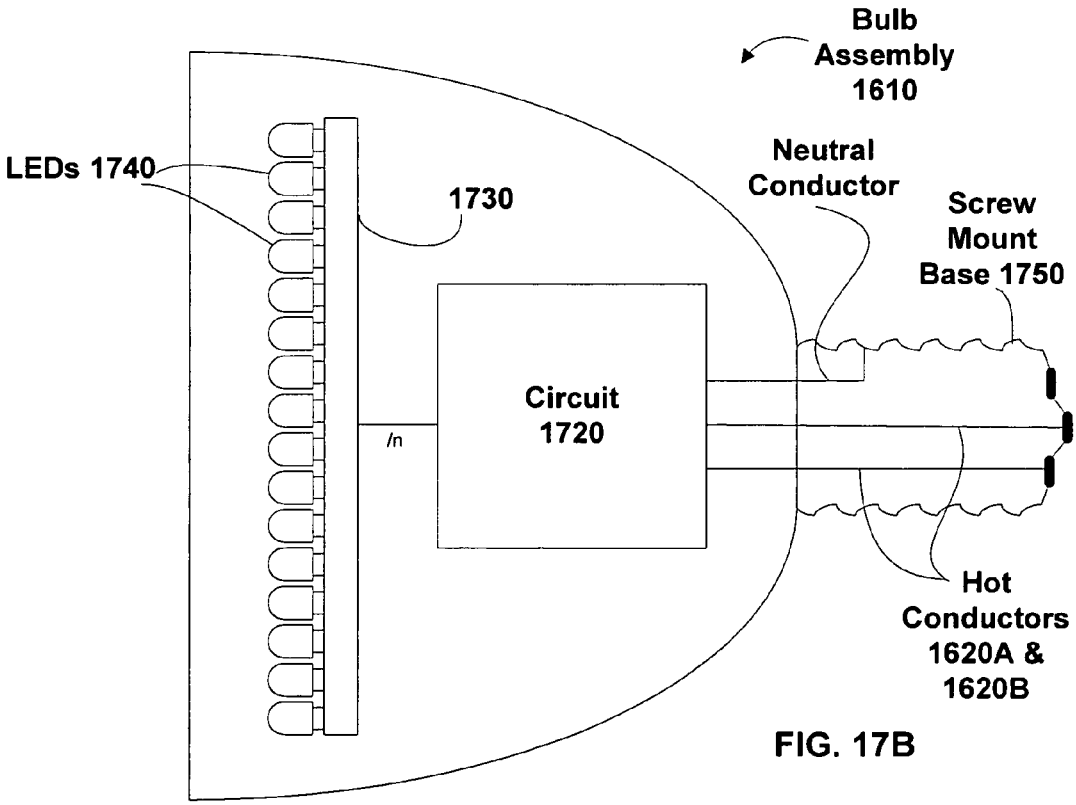
FIG. 17B illustrates a cross-section of a Bulb Assembly including LEDs, a housing, a circuit, and three Conductors in a screw mount base, according to various embodiments of the invention.

An example of a base is included in FIG. 17B, which illustrates a cross-section of a Bulb Assembly 1610 including a Screw Mount Base 1750. Another example of a base is illustrated in FIG. 17C, which illustrates a cross-section of a Bulb Assembly 1610 including a Bayonet Mount Base 1755.

Figure 17D:
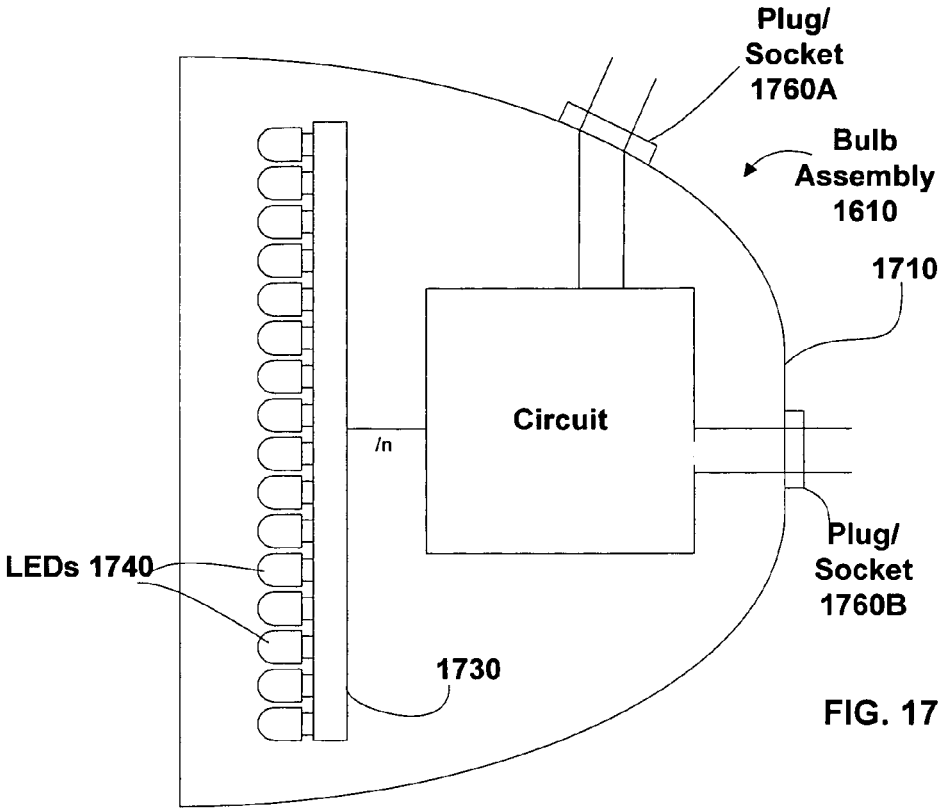
FIG. 17D illustrates a cross-section of a Bulb Assembly including LEDs, a housing, a circuit, and three Conductors distributed among two different plug/sockets, according to various embodiments of the invention.
Figure 17C:
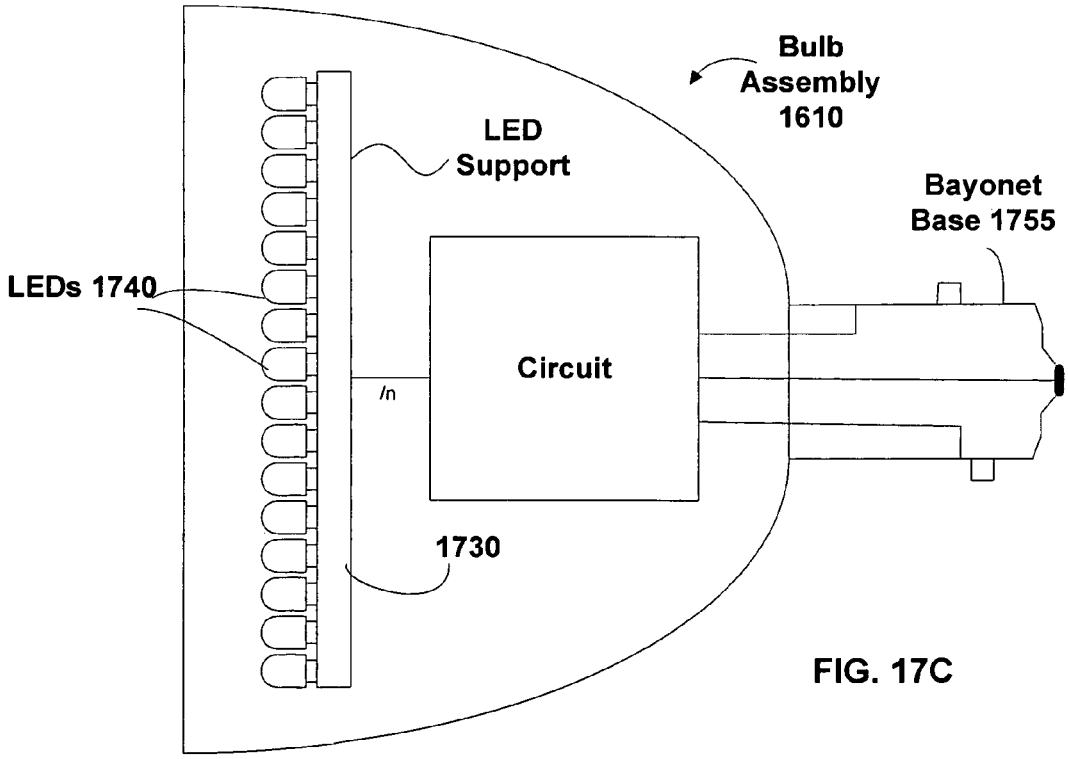
FIG. 17C illustrates a cross-section of a Bulb Assembly including LEDs, a housing, a circuit, and three Conductors in a bayonet mount base, according to various embodiments of the invention.

FIG. 17D illustrates cross-section of Bulb Assembly 1610 including two plug/sockets 1760A and 1760B. Plug/sockets 1760A and 1760B each include a plug, socket or asexual connector. Plug/sockets 1760A and 1760B each also include one each of Hot Conductors 1620A and 1620B. Thus, in one embodiment, Hot Conductor 1620A is disposed within Plug/socket 1760A, and Hot Conductor 1620B is disposed within Plug/Socket 1760B. The embodiments illustrated by FIG. 17D may improve compatibility of the invention with prior art wiring systems. For example, when a prior art traffic housing including for lamps is replaced by housing 505 including three lamps, the already existing wiring from electronic console 1220 may include two cables that were previously used to power two separate lamps of the prior art traffic housing. Within Traffic Signal 550 these two cables may be connected to Plug/sockets 1760A and 1760B, respectively. The embodiments of the invention illustrated by FIG. 17D (and also 18A and 18B) may, therefore, be more compatible with existing prior art infrastructure than, for example, those embodiments of the invention illustrated by FIG. 16B.

Plug/sockets 1760A and 1760B are optionally disposed in positions other than those shown in FIG. 17D.

Figure 18A:
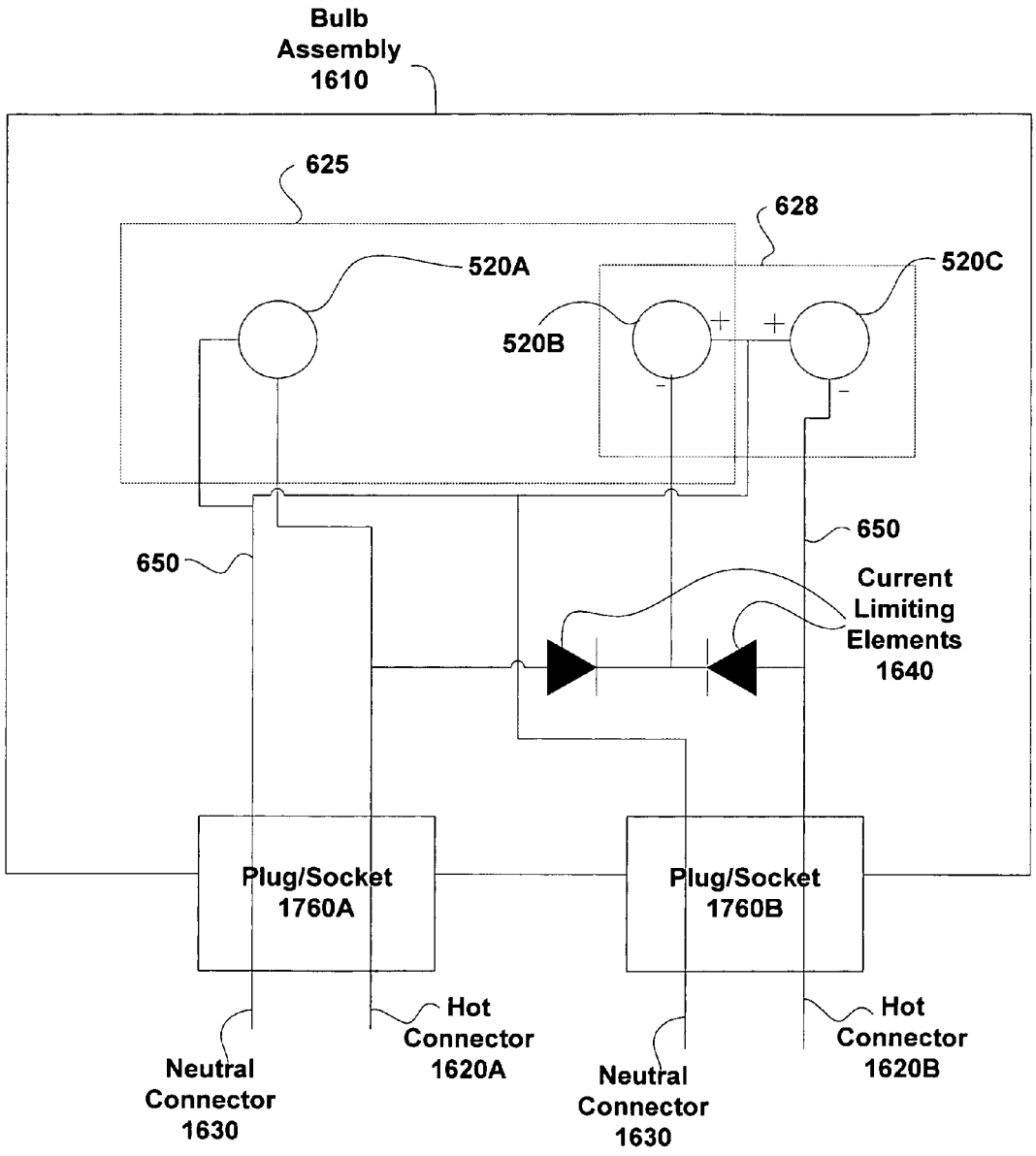
FIGS. 18A and 18B illustrate block diagrams of a Bulb Assembly including two different plug/sockets, according to various embodiments of the invention.
Figure 18B:
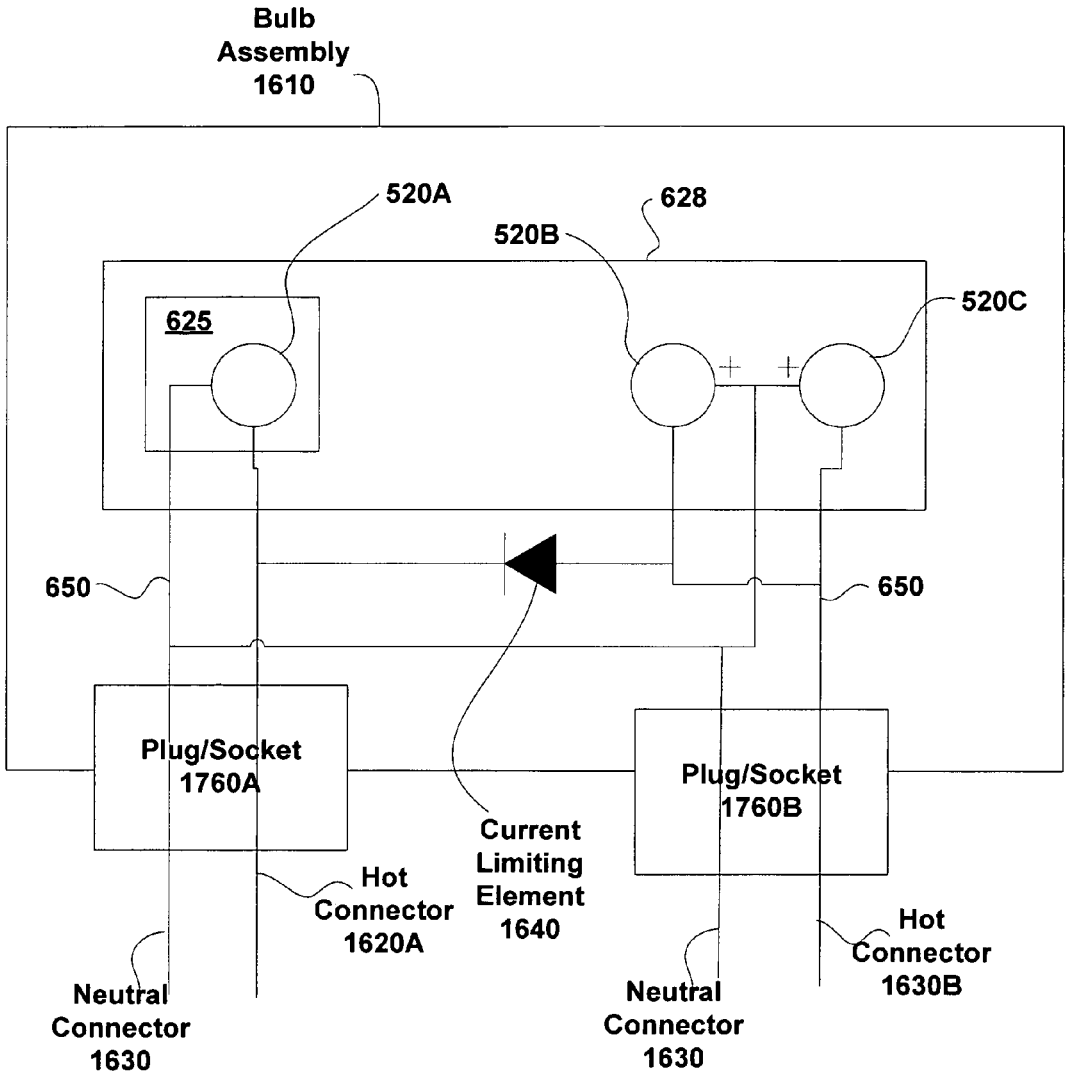

FIGS. 18A and 18B illustrate block diagrams of a Bulb Assembly 1610, such as that illustrated in FIG. 17D, including two different plug/sockets, according to various embodiments of the invention.

From the description of the various embodiments of the process and apparatus set forth supra, it will be apparent to one of ordinary skill in the art that variations and additions to the embodiments can be made without departing from the principles of the present invention. For example, alternative arrangements and numbers of Current Limiting Components 1640 may be used to achieve results similar to those described herein. Further, bulb groups 625 and 628 may be used to from patterns other than those shown. The number of bulb 520 shown in lamp 510 are illustrative only and not meant to be limiting. Typical implementations of lamp 510 will have more bulbs 520 than shown in the FIGs. A larger number of bulbs will improve the resolution of displayed patterns. In an alternative embodiment bulb 520 and some associated electrical connections are replaced by fiber optics. In this embodiment, patterns meaningful to traffic control are formed by arranging outputs of the fiber optics. Traffic controlled by traffic signal 550 includes travel by vehicular locomotion means such as truck, automobile, bicycle, aircraft, railroad, or the like. Traffic signal 550 optionally includes three or more lamps 510.

I claim:

1. A traffic lamp bulb assembly including a traffic lamp bulb, the traffic lamp bulb assembly comprising:

a base configured to couple the traffic lamp bulb to a traffic signal;

a first set of LEDs configured to display a first pattern meaningful to traffic control, the first pattern being of a first color;

a second set of LEDs configured to display a second pattern meaningful to traffic control, the second pattern being of the first color;

a first hot conductor configured to conduct current between the traffic lamp bulb and the traffic signal;

a second hot conductor configured to conduct current between the traffic lamp bulb and the traffic signal;

a neutral conductor configured to form a circuit with the first hot conductor or the second hot conductor; and a circuit configured to power the first set of LEDs when power is applied to the first hot conductor, and to power the second set of LEDs when power is applied to the second hot conductor, wherein the base includes a screw mount type base or a bayonet type base, the base having the first hot conductor and the neutral conductor but not the second hot conductor.

2. The traffic lamp bulb assembly of claim 1, wherein the circuit is configured to power both the first set of LEDs and the second set of LEDs when power is applied to the second hot conductor.

3. The traffic lamp bulb assembly of claim 1, wherein the first set of LEDs and the second set of LEDs include at least one LED in common.

4. The traffic lamp bulb assembly of claim 1, wherein the base is a bayonet type base.

5. The traffic lamp bulb assembly of claim 1, wherein the base includes a screw mount type base.

6. The traffic lamp bulb assembly of claim 1, wherein the first hot conductor is disposed in a first plug or socket, and the second hot conductor is disposed in a second plug or socket.

7. The traffic lamp bulb assembly of claim 1, wherein the circuit includes one or more current limiting elements.

8. The traffic lamp bulb assembly of claim 1, wherein the circuit includes a current limiting element configured such that when voltage is applied to the first hot conductor but not the second hot conductor only LEDs included in the first set of LEDs are turned on, and when voltage is applied to the second hot conductor but not the first hot conductor only LEDs included in the second set of LEDs are turned on, the first set of LEDs and the second set of LEDs including at least one LED in common.

9. The traffic lamp bulb assembly of claim 8, wherein the current limiting element comprises a diode.

10. The traffic lamp bulb assembly of claim 1, wherein the circuit includes a current limiting element configured such that when voltage is applied to the first hot conductor but not the second hot conductor only LEDs included in the first set of LEDs are turned on and when voltage is applied to the second hot conductor but not the first hot conductor LEDs included in both the first set of LEDs and the second set of LEDs are turned on.

11. The traffic lamp bulb assembly of claim 1, wherein the power applied to the first hot conductor and the power applied to the second hot conductor passes through the first and second sets of LEDs, respectively.

12. A system comprising:

abuse coupled to an LED support and configured to couple a traffic lamp bulb to a traffic signal;

a first set of LEDs coupled to the LED support and configured to display a first pattern meaningful to traffic control;

a second set of LEDs coupled to the LED support and configured to display a second pattern meaningful to traffic control;

a first hot conductor disposed in a first plug or socket;

a second hot conductor disposed in a second plug or socket;

a neutral conductor configured to form a circuit with the first hot conductor or the second hot conductor; and a circuit configured to power the first set of LEDs when voltage is applied to the first hot conductor, and to power the second set of LEDs when voltage is applied to the second hot conductor, wherein the base includes the first hot conductor and the neutral conductor but not the second hot conductor.

13. The system of claim 12, further comprising (a) an external circuit configured to control the first set of LEDs and the second set of LEDs independently, (b) a housing configured to support a first traffic signal bulb and a second traffic signal bulb, the second traffic signal bulb including the first set of LEDs and the second set of LEDs, and (c) a housing support.

14. A system comprising a first set of LEDs configured to display a first pattern meaningful to traffic control;

a second set of LEDs configured to display a second pattern meaningful to traffic control, the first set of LEDs and the second set of LEDs having at least one LED in common;

a first hot conductor configured to convey power to the first set of LEDs;

a second hot conductor configured to convey power to the second set of LEDs;

a neutral conductor; and means for turning on only the first set of LEDs when voltage is applied to the first hot conductor and for turning on the second set of LEDs when voltage is applied to the second hot conductor, wherein a polarity of one or more members of the first set of LEDs or the second set of LEDs are configured match a polarity of one or more current limiting elements.

15. The system of claim 14, wherein only the second set of LEDs are turned on when the voltage is applied to the second hot conductor.

16. The system of claim 14, further including means for connecting the first hot conductor, the second hot conductor and the neutral conductor to an external circuit.

17. The system of claim 14, further including (a) an external circuit configured to control the first set of LEDs and the second set of LEDs independently, (b) a housing configured to support a first traffic signal bulb and a second traffic signal bulb, the second traffic signal bulb including the first set of LEDs and the second set of LEDs, and (c) means for supporting the housing.

18. A system comprising:

a base coupled to an LED support and configured to couple a traffic lamp bulb to a traffic signal;

a first set of LEDs coupled to the LED support and configured to display a first pattern meaningful to traffic control;

a second set LEDs coupled to the LED support and configured to display a second pattern meaningful to traffic control;

a first hot conductor disposed in a first plug or socket;

a second hot conductor disposed in a second plug or socket;

a first neutral conductor configured to form a circuit with the first hot conductor or the second hot conductor;

a circuit configured to power the first set of LEDs when voltage is applied to the first hot conductor, and to power the second set of LEDs when voltage is applied to the second hot conductor; and a second neutral conductor configured to form a circuit with the first hot conductor or the second hot conductor, the neutral conductors being disposed in different sockets or bases.

19. The system of claim 18 wherein the first pattern and the second pattern are both of the same color.

20. The system of claim 19, wherein the first neutral conductor is disposed in at least the first plug or socket or the second plug or socket.

21. The system of claim 18, further comprising (a) an external circuit configured to control the first set of LEDs and the second set of LEDs independently, (b) a housing configured to support a first traffic signal bulb and a second traffic signal bulb, the second traffic signal bulb including the first set of LEDs and the second set of LEDs, and (c) a housing support.

22. A system comprising a first set of LEDs configured to display a first pattern meaningful to traffic control;

a second set of LEDs configured to display a second pattern meaningful to traffic control, the first set of LEDs and the second set of LEDs having at least one LED in common;

a first hot conductor configured to convey power to the first set of LEDs;

a second hot conductor configured to convey power to the second set of LEDs;

a neutral conductor; and means for turning on only the first set of LEDs when voltage is applied to the first hot conductor and for turning on the second set of LEDs when voltage is applied to the second hot conductor, wherein the means for turning on only the first set of LEDs when voltage is applied to the first hot conductor and for turning on the second set of LEDs when voltage is applied to the second hot conductor comprises a base that includes the first hot conductor and the neutral conductor but not the second hot conductor.

23. The system of claim 22, wherein the first pattern and the second pattern are both of the same color.

* * * * *